US010224607B2

(12) United States Patent
Kim et al.

(10) Patent No.: US 10,224,607 B2
(45) Date of Patent: Mar. 5, 2019

(54) ANTENNA DEVICE AND ELECTRONIC DEVICE INCLUDING SAME

(71) Applicant: Samsung Electronics Co., Ltd., Gyeonggi-do (KR)

(72) Inventors: Bomyoung Kim, Gyeonggi-do (KR); Jungho Park, Gyeonggi-do (KR); Byungman Lim, Seoul (KR); Young-Jun Cho, Seoul (KR)

(73) Assignee: Samsung Electronics Co., Ltd (KR)

( * ) Notice: Subject to any disclaimer, the term of this patent is extended or adjusted under 35 U.S.C. 154(b) by 54 days.

(21) Appl. No.: 15/217,496

(22) Filed: Jul. 22, 2016

(65) Prior Publication Data

US 2017/0047638 A1 Feb. 16, 2017

(30) Foreign Application Priority Data

Aug. 13, 2015 (KR) ..... 10-2015-0114620

(51) Int. Cl.

| | |
|---|---|
| ***H01Q 1/24*** | (2006.01) |
| ***H01Q 1/48*** | (2006.01) |
| ***H01Q 1/40*** | (2006.01) |
| ***H01Q 21/28*** | (2006.01) |
| ***H01Q 9/42*** | (2006.01) |

(52) U.S. Cl.

CPC ..... *H01Q 1/243* (2013.01); *H01Q 1/40* (2013.01); *H01Q 1/48* (2013.01); *H01Q 9/42* (2013.01); *H01Q 21/28* (2013.01)

(58) Field of Classification Search

CPC ..... H01Q 1/243; H01Q 1/48; H01Q 1/40; H01Q 21/28; H01Q 21/48; H04B 1/40

USPC ..... 343/702

See application file for complete search history.

(56) References Cited

U.S. PATENT DOCUMENTS

| | | | | |
|---|---|---|---|---|
| 7,612,725 | B2 | 11/2009 | Hill et al. | |
| 2014/0266922 | A1* | 9/2014 | Jin | H01Q 21/28 343/702 |
| 2015/0171916 | A1* | 6/2015 | Asrani | H04B 1/68 455/575.7 |

* cited by examiner

*Primary Examiner* — Hai Tran

(74) *Attorney, Agent, or Firm* — The Farrell Law Firm, P.C.

(57) ABSTRACT

An electronic device is provided that includes a housing, a first conductive member configured to form a part of the housing, or be partially disposed within the housing, wherein the first conductive member includes a first conductive protrusion disposed toward the inside of the housing, a second conductive member configured to form another part of the housing, wherein the second conductive member includes a portion disposed adjacent to a portion of the first conductive member and a second conductive protrusion disposed toward the inside of the housing, a non-conductive member disposed between the portion of the first conductive member and the portion of the second conductive member, a coupling structure that includes a conductor and is connected between the first conductive protrusion and the second conductive protrusion, and at least one communication circuit electrically connected to the second conductive member.

18 Claims, 14 Drawing Sheets

| Passive Gain (dB) | LTE B41 | | | | |
|---|---|---|---|---|---|
| | Low ch. | Mid ch. | High ch. | Avg. | NOTE |
| NO TFA | -6.24 | -6.1 | -6.78 | -6.45 | INCAPABLE OF ENSURING PERFORMANCE |
| COUPLING TFA TO BOTH TERMINALS | -4.8 | -4.53 | -4.89 | -4.77 | PROBLEM RELATING TO DC |
| COUPLING TFA TO ONLY LEFT TERMINAL | -4.8 | -4.22 | -4.18 | -4.51 | EQUIVALENT TO COUPLING TFA TO BOTH TERMINALS |
| COUPLING TFA TO ONLY RIGHT TERMINAL | -5.07 | -4.58 | -4.84 | -4.91 | EQUIVALENT TO COUPLING TFA TO BOTH TERMINALS |
| COUPLING TFA TO BOTH TERMINALS + STACKING TFA | -5.02 | -4.62 | -4.93 | -4.95 | EQUIVALENT TO COUPLING TFA TO BOTH TERMINALS |

FIG.9B

ANTENNA DEVICE AND ELECTRONIC DEVICE INCLUDING SAME

PRIORITY

This application claims priority under 35 U.S.C. § 119(a) to Korean Patent Application Serial No. 10-2015-0114620, which was filed in the Korean Intellectual Property Office on Aug. 13, 2015, the entire content of which is incorporated herein by reference.

BACKGROUND

1. Field of the Disclosure

The present disclosure generally relates to an electronic device, and more particularly, to an electronic device that includes an antenna device.

2. Description of the Related Art

Electronic devices have become slimmer in order to meet consumers' needs as the functional gap therebetween has significantly decreased. Electronic device makers have made electronic devices slim while increasing the rigidity thereof, as well as improving the design. Reflecting this trend, electronic devices have been developed to efficiently ensure an arrangement at least one antenna device necessarily required for communication among the elements thereof, to prevent a degradation in radiation performance, and to achieve excellent performance.

Antenna devices used in electronic devices have an inverted-f antenna (IFA) or a monopole radiator as a basic structure, and the volume and the number of antenna radiators to be mounted may be determined according to the frequency, bandwidth, and type of each service. Further, antenna devices may include antennas for various wireless communication services, such as Bluetooth (BT), a global positioning system (GPS), WIFI, etc. A plurality of antennas are required to support various services, but electronic devices may have limited antenna volume spaces. In order to overcome the problem, multiple separate antennas may be designed by collecting service bands having similar frequency bands.

In a case where the exterior of an electronic device, or at least a part of the interior thereof, is formed of a conductive member (e.g., a metal bezel, etc.), an antenna is not separately designed, and the conductive member may be used as an antenna radiator so that it may be designed as an antenna, as opposed to a dielectric injection-molded material.

For example, in a case where a conductive member arranged on the outer periphery of an electronic device is used as an antenna radiator, specific locations of the conductive member are cut off by dielectric cut-off portions in order to adjust the physical length from a power supply unit to the antenna, thereby enabling the antenna to operate in a desired frequency band.

In a case where one of the unit conductive members into which the conductive member is divided is used as an antenna radiator and the ground portion electrically connected to another conductive member is used, the operating frequency band may be shifted from a high frequency band to a low frequency band due to an increase in the electrical length, but may not be easily shifted from a low frequency band to a high frequency band.

SUMMARY

Various aspects of the present disclosure provide an antenna device and an electronic device that includes the same.

Various aspects of the present disclosure provide an antenna device that contributes to enhancing the radiation performance of an antenna while enhancing a sensing function and optimizing a leakage current, and provides an electronic device that includes the same.

Accordingly, an aspect of the present disclosure provides an electronic device that includes a housing, a first conductive member configured to form a part of the housing, or at least partially disposed within the housing, wherein the first conductive member includes a first conductive protrusion directed toward the inside of the housing, a second conductive member configured to form another part of the housing, wherein the second conductive member includes a portion disposed adjacent to a portion of the first conductive member and a second conductive protrusion directed toward the inside of the housing, a non-conductive member disposed between the portion of the first conductive member and the portion of the second conductive member, a coupling structure that is connected between the first conductive protrusion and the second conductive protrusion and includes a conductor, and at least one communication circuit electrically connected to the second conductive member.

BRIEF DESCRIPTION OF THE DRAWINGS

The above and other aspects, features, and advantages of the present disclosure will be more apparent from the following detailed description taken in conjunction with the accompanying drawings, in which:

FIGS. 9A and 9B are a graph and a comparison table respectively that represent efficiencies according to coupling structures between two conductive members, according to various embodiments of the present disclosure.

DETAILED DESCRIPTION

Figure 1:
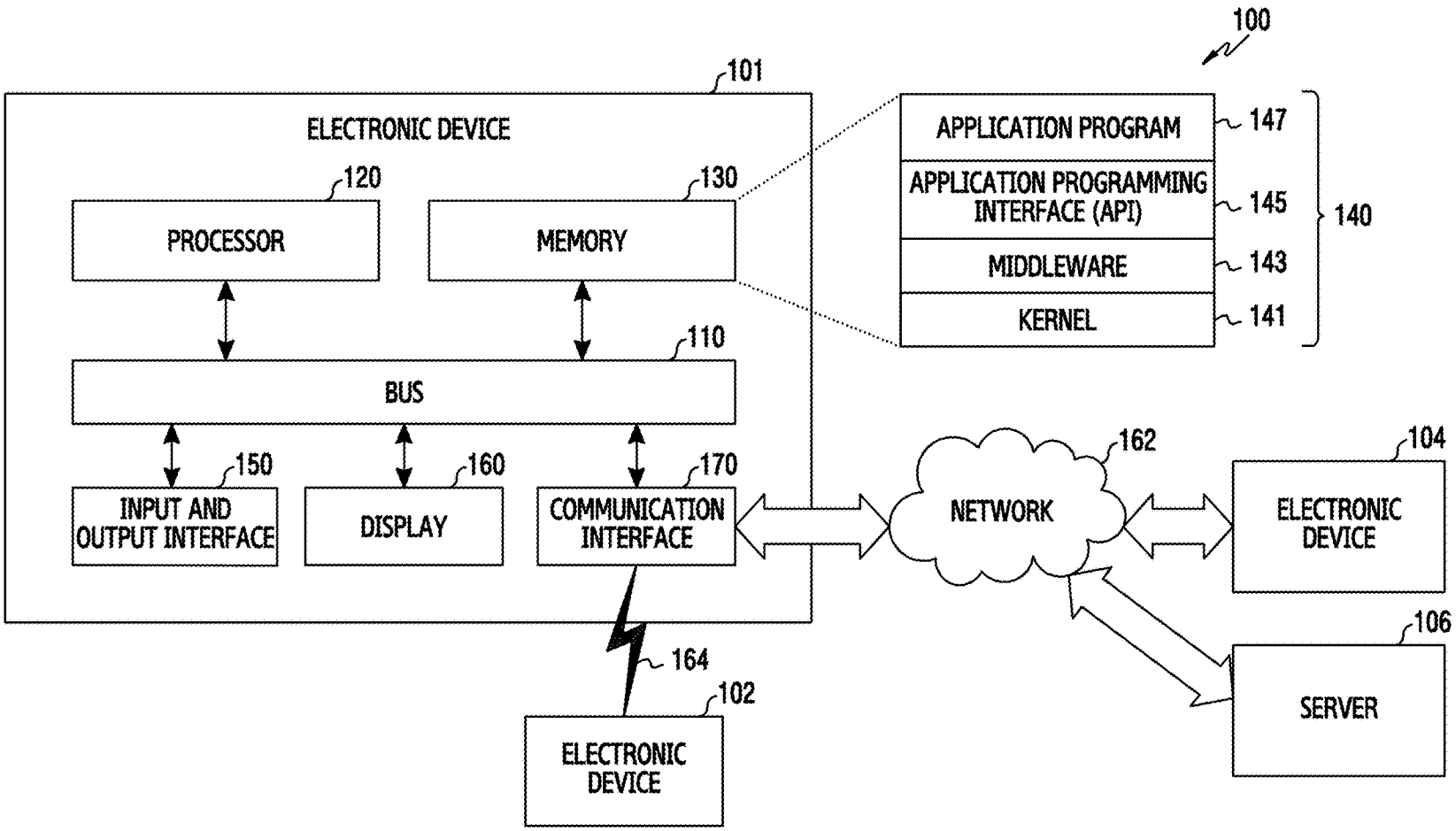
FIG. 1 illustrates a network environment that includes an electronic device, according to various embodiments of the present disclosure.

The following description, with reference to the accompanying drawings, is provided to assist in a comprehensive understanding of various embodiments of the present disclosure as defined by the claims and their equivalents. The description includes various specific details to assist in that understanding, but these details are to be regarded as mere examples. For example, those of ordinary skill in the art will recognize that various changes and modifications of the various embodiments described herein may be made without departing from the scope and spirit of the present disclosure. In addition, descriptions of well-known functions and constructions may be omitted for clarity and conciseness.

The terms and words used in the following description and claims are not limited to their dictionary meanings, but are used to enable a clear and consistent understanding of the present disclosure. Accordingly, it should be apparent to those skilled in the art that the following description of various embodiments of the present disclosure is provided for illustration purposes only and does not limit the present disclosure as defined by the appended claims and their equivalents.

Herein, singular forms such as "a," "an," and "the" include plural forms unless the context clearly dictates otherwise. Thus, for example, reference to "a component surface" includes reference to one or more of such surfaces.

The term "substantially" indicates that the recited characteristic, parameter, or value need not be achieved exactly, but that deviations or variations, including, for example, tolerances, measurement error, measurement accuracy limitations and other factors known to those of skill in the art, may occur in amounts that do not preclude the effect the characteristic was intended to provide.

The terms "have," "may have," "include," and "may include" indicate the presence of corresponding features, numbers, functions, parts, operations, elements, etc., but do not limit additional one or more features, numbers, functions, parts, operations, elements, etc.

The terms "A or B," "at least one of A or/and B", and "one or more of A or/and B" may include any and all combinations of words enumerated with it. For example, "A or B," "at least one of A and B", and "at least one of A or B" describe (1) including A, (2) including B, or (3) including both A and B.

Although terms, such as "first" and "second" as used herein may modify various elements of various embodiments of the present disclosure, these terms do not limit the corresponding elements. For example, these terms do not limit an order and/or importance of the corresponding elements. These terms may be used for the purpose of distinguishing one element from another element. For example, a first user device and a second user device may both indicate user devices and may indicate different user devices. A first element may be referred to as a second element without departing from the scope of the present disclosure, and similarly, a second element may be referred to as a first element.

When an element (e.g., a first element) is "connected to" or "(operatively or communicatively) coupled with/to" another element (e.g., a second element), the first element may be directly connected or coupled to the second element, or there may be an intervening element (e.g., a third element) between the first element and the second element. However, when the first element is "directly connected" or "directly coupled" to the second element, there is no intervening element between the first element and the second element.

The expression "configured to (or set to)" may be used interchangeably with "suitable for," "having the capacity to," "designed to," "adapted to," "made to," or "capable of" according to the situation. The term "configured to (or set to)" does not necessarily indicate "specifically designed to" in a hardware level. Instead, the expression "an apparatus configured to . . . " may indicate that the apparatus is "capable of . . . " along with other devices or parts in a certain situation. For example, "a processor configured to (set to) perform A, B, and C" may be a dedicated processor, e.g., an embedded processor, for performing a corresponding operation, or a general-purpose processor, e.g., a central processing unit (CPU) or an application processor (AP), capable of performing a corresponding operation by executing one or more software programs stored in a memory device.

All the terms used herein, including technical and scientific terms, should be interpreted to have the same meanings as commonly understood by those skilled in the art to which the present disclosure pertains, and should not be interpreted to have ideal or excessively formal meanings, unless explicitly defined herein.

A module or programming module may include at least one constituent element among the described constituent elements of an apparatus, or may omit some of them, or may further include additional constituent elements. Operations performed by a module, programming module, or other constituent elements may be executed in a sequential, parallel, repetitive, or heuristic manner. In addition, some of the operations may be executed in a different order or may be omitted, or other operations may be added.

Herein, an electronic device may be a smart phone, a tablet personal computer (PC), a mobile phone, a video phone, an e-book reader, a desktop PC, a laptop PC, a netbook computer, a workstation, a server, a personal digital assistant (PDA), a portable multimedia player (PMP), a moving picture experts group phase 1 or phase 2 (MPEG-1 or MPEG-2) audio layer 3 (MP3) player, a mobile medical device, a camera, or a wearable device (e.g., a head-mounted-device (HMD), electronic eyeglasses, electronic clothing, an electronic bracelet, an electronic necklace, an electronic appcessory, an electronic tattoo, a smart mirror, a smart watch, etc.).

An electronic device may also be a smart home appliance, e.g., a television (TV), a digital versatile disc (DVD) player, an audio player, a refrigerator, an air conditioner, a vacuum cleaner, an oven, a microwave oven, a washing machine, an air cleaner, a set-top box, a home automation control panel, a security control panel, a TV box (e.g., Samsung HomeSync®, Apple TV®, or Google TV®), a game console (e.g., Xbox® or PlayStation®), an electronic dictionary, an electronic key, a camcorder, an electronic frame, and the like.

An electronic device may also be medical equipment, such as a mobile medical device (e.g., a blood glucose monitoring device, a heart rate monitor, a blood pressure monitoring device, a temperature meter, etc.), a magnetic resonance angiography (MRA) machine, a magnetic resonance imaging (MRI) machine, a computed tomography (CT) scanner, an ultrasound machine, etc., a navigation device, a GPS receiver, an event data recorder (EDR), a flight data recorder (FDR), an in-vehicle infotainment device, electronic equipment for a ship (e.g., a ship navigation equipment and/or a gyrocompass), avionics equipment, security equipment, a head unit for a vehicle, an industrial or home robot, an automatic teller machine (ATM), a point of sale (POS) device, or an Internet of Things (IoT) device (e.g., a light bulb, various sensors, an electronic meter, a gas meter, a sprinkler, a fire alarm, a thermostat, a streetlamp, a toaster, a sporting equipment, a hot-water tank, a heater, a boiler, etc.)

An electronic device may also be a piece of furniture, a building/structure, an electronic board, an electronic signature receiving device, a projector, and/or various measuring instruments (e.g., a water meter, an electricity meter, a gas meter, a wave meter, and the like).

An electronic device may also be a combination of one or more of the above-mentioned devices. Further, it will be apparent to those skilled in the art that an electronic device is not limited to the above-mentioned examples.

Herein, the term "user" may indicate a person who uses an electronic device or a device (e.g., an artificial intelligence electronic device) that uses the electronic device.

An electronic device of a single radio environment may provide long term evolution (LTE) service using circuit switched fall back (CSFB) that determines whether paging information of a circuit switched (CS) service network is received over an LTE network. When receiving a paging signal of the CS service network over the LTE network, the electronic device connects (or accesses) the CS service network (e.g., a 2nd generation (2G)/3rd generation (3G) network) and provides a voice call service. For example, the 2G network may include one or more of a global system for mobile communication (GSM) network and a code division multiple access (CDMA) network. The 3G network may include one or more of a wideband-CDMA (WCDMA) network, a time division-synchronous CDMA (TD-SCDMA) network, and an evolution-data optimized (EV-DO) network.

Alternatively, the electronic device of the single radio environment may provide LTE service using single radio LTE (SRLTE), which determines whether the paging information is received by periodically switching every radio resource (e.g., receive antennas) to the CS service network (e.g., the 2G/3G network). Upon receiving the paging signal of the CS service network, the electronic device provides the voice call service by connecting the CS service network (e.g., the 2G/3G network).

Alternatively, the electronic device of the single radio environment may provide LTE service using single radio dual system (SRDS), which determines whether the paging information is received by periodically switching some of radio resources (e.g., receive antennas) to the CS service network (e.g., the 2G/3G network). Upon receiving the paging signal of the CS service network, the electronic device provides the voice call service by connecting the CS service network (e.g., the 2G/3G network).

FIG. 1 illustrates a network environment including an electronic device according to an embodiment of the present disclosure. Referring to FIG. 1, an electronic device 101 includes a bus 110, a processor 120, a memory 130, an input/output interface 150, a display 160, and a communication interface 170. Alternatively, the electronic device 100 may omit at least one of the components and/or include an additional component.

The bus 110 includes a circuit for connecting the components (e.g., the processor 120, the memory 130, the input/output interface 150, the display 160, and the communication interface 170) and delivering communications (e.g., a control message) therebetween.

The processor 120 includes one or more of a CPU, an AP, and a communication processor (CP). The processor 120 processes an operation or data for control of and/or communication with another component of the electronic device 101.

The processor 120, which may be connected to the LTE network, determines whether a call is connected over the CS service network using caller identification information (e.g., a caller phone number) of the CS service network (e.g., the 2G/3G network). For example, the processor 120 may receive incoming call information (e.g., a CS notification message or a paging request message) of the CS service network over the LTE network (e.g., CSFB). For example, the processor 120 being connected to the LTE network may receive incoming call information (e.g., a paging request message) over the CS service network (e.g., SRLTE).

When receiving the incoming call information (e.g., a CS notification message or a paging request message) of the CS service network over the LTE network, the processor 120 may obtain caller identification information from the incoming call information. The processor 120 displays the caller identification information on its display 160. The processor 120 may determine whether to connect the call based on input information corresponding to the caller identification information displayed on the display 160. For example, when detecting input information corresponding to an incoming call rejection, through the input/output interface 150, the processor 120 may restrict the voice call connection and maintains the LTE network connection. For example, when detecting input information corresponding to an incoming call acceptance, through the input/output interface 150, the processor 120 connects the voice call by connecting to the CS service network.

When receiving the incoming call information (e.g., a CS notification message or a paging request message) of the CS service network over the LTE network, the processor 120 may obtain caller identification information from the incoming call information. The processor 120 may determine whether to connect the call by comparing the caller identification information with a reception control list. For example, when the caller identification information is included in a first reception control list (e.g., a blacklist), the processor 120 may restrict the voice call connection and maintain the connection to the LTE network. For example, when the caller identification information is not included in the first reception control list, the processor 120 may connect the voice call by connecting to the CS service network. For example, when the caller identification information is included in a second reception control list (e.g., a white list), the processor 120 connects the voice call by connecting to the CS service network.

When receiving the incoming call information (e.g., a paging request message) of the CS service network over the LTE network, the processor 120 may transmit an incoming call response message (e.g., a paging response message) to the CS service network. The processor 120 may suspend the LTE service and receive the caller identification information (e.g., a CS call setup message) from the CS service network. The processor 120 may determine whether to connect the call by comparing the caller identification information with the reception control list. For example, when the caller identification information is included in the first reception control list, the processor 120 may restrict the voice call connection and resume the LTE network connection. For example, when the caller identification information is not included in the first reception control list, the processor 120 may connect the voice call by connecting to the CS service network. For example, when the caller identification information is included in the second reception control list, the processor 120 connects the voice call by connecting to the CS service network.

The memory 130 may include volatile and/or nonvolatile memory. The memory 130 may store commands or data (e.g., the reception control list) relating to at least another component of the electronic device 101. The memory 130 stores software and/or a program 140. The program 140 includes a kernel 141, middleware 143, an application programming interface (API) 145, and applications 147. At least some of the kernel 141, the middleware 143, and the API 145 may be referred to as an operating system (OS).

The kernel 141 may control or manage system resources (e.g., the bus 110, the processor 120, or the memory 130) used for performing an operation or function implemented by the other programs (e.g., the middleware 143, the API 145, or the applications 147). Further, the kernel 141 provides an interface through which the middleware 143, the API 145, or the applications 147 may connect the individual elements of the electronic device 101 to control or manage the system resources.

The middleware 143 may function as an intermediary for the API 145 or the applications 147 to communicate with the kernel 141 and exchange data. In addition, the middleware 143 may process one or more task requests received from the applications 147 according to priorities thereof. For example, the middleware 143 may assign priorities for using the system resources (e.g., the bus 110, the processor 120, the memory 130, and the like) of the electronic device 101, to at least one of the applications 147. For example, the middleware 143 may perform scheduling or load balancing on the one or more task requests by processing the one or more task requests according to the priorities assigned thereto.

The API 145 is an interface through which the applications 147 control functions provided from the kernel 141 or the middleware 143, and may include at least one interface or function (e.g., an instruction) for file control, window control, image processing, text control, etc.

The input/output interface 150 transfers instructions or data input from a user or another external device to the other element(s) of the electronic device 101. Further, the input/output interface 150 outputs the instructions or data received from the other element(s) of the electronic device 101 to the user, a first external electronic device 102, a second external electronic device 104, or a server 106.

The display 160 may include a liquid crystal display (LCD), a light emitting diode (LED) display, an organic LED (OLED) display, a micro electro mechanical system (MEMS) display, an electronic paper display, etc. The display 160 displays various types of content (e.g., a text, images, videos, icons, symbols, webpages, etc.) for the user. The display 160 may include a touch screen that receives a touch input, a gesture input, a proximity input, a hovering input, etc., from an electronic pen or the user's body part.

The communication interface 170 establishes communication between the electronic device 101 and the first external electronic device 102, the second external electronic device 104, or the server 106. For example, the communication interface 170 may communicate with the first external electronic device 102 through a wireless communication or a wired communication 164, and communicate with the second external electronic device 104 or the server 106 in connection to a network 162 through wireless communication or wired communication. For example, the wireless communication may conform to a cellular communication protocol including at least one of LTE, LTE-advanced (LTE-A), CDMA, WCDMA, universal mobile telecommunications system (UMTS), wireless broadband (WiBro), and GSM.

The wired communication 164 may include at least one of universal serial bus (USB), high definition multimedia interface (HDMI), recommended standard 232 (RS-232), and plain old telephone service (POTS).

The network 162 may include a telecommunications networks, a computer network (e.g., a local area network (LAN) or a wide area network (WAN)), the Internet, a telephone network, etc.

The electronic device 101 provides the LTE service in the single radio environment by use of at least one module functionally or physically separated from the processor 120.

Various embodiments of the present disclosure will be described with reference to a display that includes a bent or curved area and is applied to a housing of an electronic device 101, in which a non-metal member and a metal member (e.g., a metal bezel) are formed through dual injection molding, but are not limited thereto. For example, the display 160 may be applied to a housing, in which a metal member or a non-metal member is formed of a single material.

Each of the first external electronic device 102 and the second external electronic device 104 may be the same or a different type of device as the electronic device 101.

The server 106 may include a group of one or more servers.

All or some of the operations executed by the electronic device 101 may be executed by the first external electronic device 102, the second external electronic device 104, and/or the server 106. For example, when the electronic device 101 performs a certain function, the electronic device 101 may request some functions that are associated with the function from the first external electronic device 102, the second external electronic device 104, and/or the server 106, instead of, or in addition to, executing the function or service by itself. The first external electronic device 102, the second external electronic device 104, or the server 106 may execute the requested functions or additional functions, and may transmit the results to the electronic device 101. The electronic device 101 may provide the requested functions or services by processing the received results as they are or additionally. For example, a cloud computing technique, a distributed computing technique, or a client-server computing technique may be used.

In the following description of the present disclosure, conductive members used as antenna radiators are exemplified by conductive members that are disposed along the outer periphery of an electronic device, but they are not limited thereto. For example, various metal structures provided in the electronic device may be used as antenna radiators. According to an embodiment of the present disclosure, the electronic device may be a bar type electronic device, but it is not limited thereto. For example, the electronic device may be one of electronic devices of various opening/closing types or a wearable device.

Figure 2:
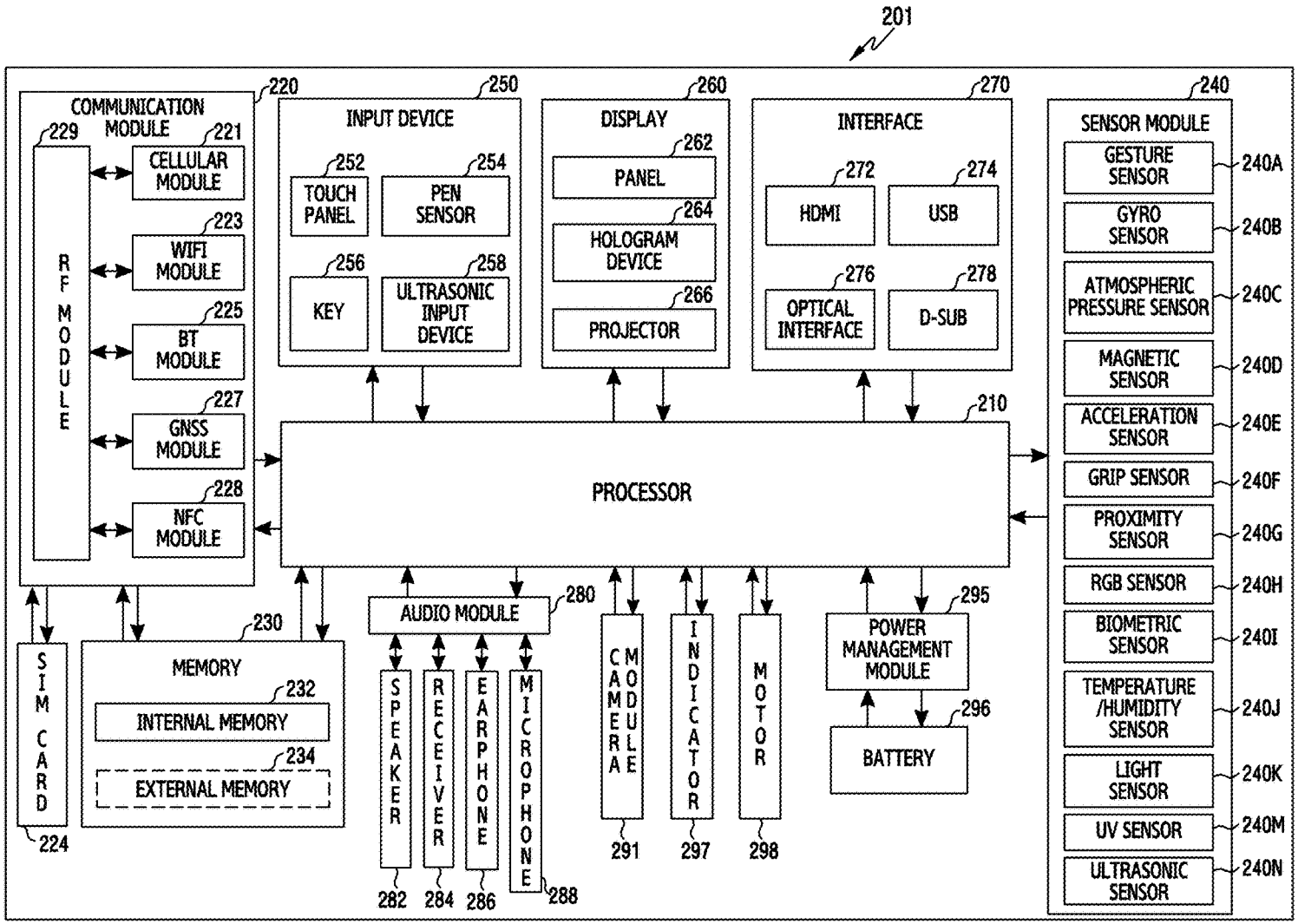
FIG. 2 is a block diagram of an electronic device according to various embodiments of the present disclosure.

FIG. 2 is a diagram of a configuration of an electronic device 201, according to an embodiment of the present disclosure.

Referring to FIG. 2, a configuration of the electronic device 201 is provided. The electronic device 201 may include all or some of the components described with reference to the electronic device 101 of FIG. 1. The electronic device 201 includes at least one application processor (AP) 210, a communication module 220, a subscriber identification module (SIM) card 224, a memory 230, a sensor module 240, an input device 250, a display 260, an interface 270, an audio module 280, a camera module 291, a power management module 295, a battery 296, an indicator 297, and a motor 298.

The AP 210 controls a plurality of hardware or software elements connected to the AP 210 by driving an operating system (OS) or an application program. The AP 210 processes a variety of data, including multimedia data, and performs arithmetic operations. The AP 210 may be implemented, for example, with a system on chip (SoC). The AP 210 may further include a graphical processing unit (GPU).

The communication module 220 performs data transmission/reception in communication between the external electronic device 104 or the server 106 which may be connected with the electronic device 201 through the network 162. The communication module 220 includes a cellular module 221, a wireless fidelity (Wi-Fi) module 223, a BT module 225, a global navigation satellite system (GNSS) or GPS module 227, a near filed communication (NFC) module 228, and a radio frequency (RF) module 229.

The cellular module 221 provides a voice call, a video call, a text service, an internet service, and the like, through a communication network (e.g., LTE, LTE-A, CDMA, WCDMA, UMTS, WiBro, and GSM, and the like). In addition, the cellular module 221 identifies and authenticates the electronic device 201 within the communication network by using the SIM card 224. The cellular module 221 may perform at least some of functions that may be provided by the AP 210. For example, the cellular module 221 may perform at least some of multimedia control functions.

The cellular module 221 includes a communication processor (CP). Further, the cellular module 221 may be implemented, for example, with an SoC. Although elements, such as the cellular module 221 (e.g., the CP), the memory 230, and the power management module 295 are illustrated as separate elements with respect to the AP 210 in FIG. 2, the AP 210 may also be implemented such that at least one part (e.g., the cellular module 221) of the aforementioned elements is included in the AP 210.

The AP 210 or the cellular module 221 loads an instruction or data, which is received from each non-volatile memory connected thereto, or at least one of different elements, to a volatile memory and processes the instruction or data. In addition, the AP 210 or the cellular module 221 stores data, which is received from at least one of different elements or generated by at least one of different elements, into the non-volatile memory.

Each of the Wi-Fi module 223, the BT module 225, the GNSS module 227, and the NFC module 228 includes a processor for processing data transmitted/received through a corresponding module. Although the cellular module 221, the Wi-Fi module 223, the BT module 225, the GNSS module 227, and the NFC module 228 are illustrated in FIG. 2 as separate blocks, at least some (e.g., two or more) of the cellular module 221, the Wi-Fi module 223, the BT module 225, the GNSS module 227, and the NFC module 228 may be included in one integrated chip (IC) or IC package. For example, at least some of processors corresponding to the cellular module 221, the Wi-Fi module 223, the BT module 225, the GNSS module 227, and the NFC module 228 (e.g., a communication processor corresponding to the cellular module 221 and a Wi-Fi processor corresponding to the Wi-Fi module 223) may be implemented with an SoC.

The RF module 229 transmits/receives data, for example an RF signal. The RF module 229 may include, for example, a transceiver, a power amp module (PAM), a frequency filter, a low noise amplifier (LNA), and the like. In addition, the RF module 229 may further include a component for transmitting/receiving a radio wave in free space in wireless communication, for example, a conductor, an antenna, a conducting wire, and the like. Although it is illustrated in FIG. 2 that the cellular module 221, the Wi-Fi module 223, the BT module 225, the GNSS module 227, and the NFC module 228 share one RF module 229, at least one of the cellular module 221, the Wi-Fi module 223, the BT module 225, the GNSS module 227, the NFC module 228 may transmit/receive an RF signal via a separate RF module.

The SIM card 224 may be inserted into a slot formed at a specific location of the electronic device 201. The SIM card 224 includes unique identification information (e.g., an integrated circuit card identifier (ICCID)) or subscriber information (e.g., an international mobile subscriber identity (IMSI)).

The memory 230 includes an internal memory 232 and/or an external memory 234.

The internal memory 232 may include, for example, at least one of a volatile memory (e.g., a dynamic random access memory (DRAM), a static RAM (SRAM), a synchronous dynamic RAM (SDRAM), and the like) or a non-volatile memory (e.g., a one time programmable read only memory (OTPROM), a programmable ROM (PROM), an erasable and programmable ROM (EPROM), an electrically erasable and programmable ROM (EEPROM), a mask ROM, a flash ROM, a not and (NAND) flash memory, a not or (NOR) flash memory, and the like). The internal memory 232 may be a solid state drive (SSD).

The external memory 234 may include a flash drive, and may further include, for example, compact flash (CF), secure digital (SD), micro-SD, mini-SD, extreme digital (xD), memory stick, and the like. The external memory 234 may be operatively coupled to the electronic device 201 via various interfaces.

The electronic device 201 may further include a storage unit (or a storage medium), such as a hard drive.

The sensor module 240 measures a physical quantity or detects an operation state of the electronic device 201, and converts the measured or detected information into an electric signal. The sensor module 240 includes, for example, at least one of a gesture sensor 240A, a gyro sensor 240B, an atmospheric pressure sensor 240C, a magnetic sensor 240D, an acceleration sensor 240E, a grip sensor 240F, a proximity sensor 240G, a color sensor 240H (e.g., a red, green, blue (RGB) sensor), a biometric sensor 240I, a temperature/humidity sensor 240J, an illumination/illuminance sensor 240K, an ultraviolet (UV) sensor 240M and ultrasonic sensor 240N.

The ultrasonic sensor 240N may include at least one ultrasonic transducer. The ultrasonic sensor 240N may include a contact type ultrasonic transducer (for example, an enclosed type ultrasonic transducer) and a non-contact type ultrasonic transducer (for example, a resonant type ultrasonic transducer), each of which are described in greater detail below. The contact type ultrasonic transducer and the non-contact type ultrasonic transducer may be controlled to be exclusively or simultaneously operated under a control of the processors 120, 220.

Additionally or alternatively, the sensor module 240 may include, for example, an E-node sensor, an electromyography (EMG) sensor, an electroencephalogram (EEG) sensor, an electrocardiogram (ECG) sensor, a fingerprint sensor, and the like.

The sensor module 240 may further include a control circuit for controlling at least one or more sensors included therein.

The input device 250 includes a touch panel 252, a (digital) pen sensor 254, a key 256, and an ultrasonic input unit 258.

The touch panel 252 recognizes a touch input, for example, by using at least one of an electrostatic type configuration, a pressure-sensitive type configuration, and an ultrasonic type configuration. The touch panel 252 may further include a control circuit. In the instance where the touch panel is of the electrostatic type, not only is physical contact recognition possible, but proximity recognition is also possible. The touch panel 252 may further include a tactile layer, which provides the user with a tactile reaction.

The (digital) pen sensor 254 may include, for example, a recognition sheet which is a part of the touch panel or is separated from the touch panel. The key 256 may include, for example, a physical button, an optical key, or a keypad. The ultrasonic input device 258 may detect ultrasonic waves generated by an input tool through a microphone 288, and may confirm data corresponding to the detected ultrasonic waves.

The (digital) pen sensor 254 may be implemented, for example, by using the same, or similar, method of receiving a touch input of the user or by using an additional sheet for recognition.

The key 256 may be, for example, a physical button, an optical key, a keypad, or a touch key.

The ultrasonic input unit 258 is a device by which the electronic device 201 detects a reflected sound wave through the microphone 288 and is capable of sound wave recognition. For example, an ultrasonic signal, which may be generated by using a pen, may be reflected off an object and detected by the microphone 288.

The electronic device 201 may use the communication module 220 to receive a user input from an external device (e.g., a computer or a server) connected thereto.

The display 260 includes a panel 262, a hologram 264, and a projector 266.

The panel 262 may be, for example, a liquid-crystal display (LCD), an active-matrix organic light-emitting diode (AM-OLED), and the like. The panel 262 may be implemented, for example, in a flexible, transparent, or wearable manner. The panel 262 may be constructed as one module with the touch panel 252.

The hologram device 264 uses an interference of light and displays a stereoscopic image in the air.

The projector 266 displays an image by projecting a light beam onto a screen. The screen may be located inside or outside the electronic device 201.

The display 260 may further include a control circuit for controlling the panel 262, the hologram device 264, or the projector 266.

The interface 270 includes, for example, an HDMI 272, a USB 274, an optical communication interface 276, or a D-subminiature (D-sub) 278. The interface 270 may be included, for example, in the communication interface 160 of FIG. 1. Additionally or alternatively, the interface 270 may include, for example, mobile high-definition link (MHL), SD/multi-media card (MMC) or infrared data association (IrDA).

The audio module 280 bilaterally converts a sound and an electric signal. At least some elements of the audio module 280 may be included in the input/output interface 150 of FIG. 1. The audio module 280 converts sound information which is input or output through a speaker 282, a receiver 284, an earphone 286, the microphone 288, and the like.

The speaker 282 may output a signal of an audible frequency band and a signal of an ultrasonic frequency band. Reflected waves of an ultrasonic signal emitted from the speaker 282 may be received, or a signal of an external audible frequency band may also be received.

The camera module 291 is a device for image and video capturing, and may include one or more image sensors (e.g., a front sensor or a rear sensor), a lens, an image signal processor (ISP), or a flash (e.g., an LED or a xenon lamp). The electronic device 201 may include two or more camera modules.

The power management module 295 manages power of the electronic device 201. The power management module 295 may include a power management integrated circuit (PMIC), a charger IC, or a battery gauge.

The PMIC may be placed inside an IC or SoC semiconductor. Charging is classified into wired charging and wireless charging. The charger IC charges a battery, and prevents an over-voltage or over-current flow from a charger. The charger IC includes a charger IC for at least one of the wired charging and the wireless charging.

The wireless charging may be classified, for example, into a magnetic resonance type, a magnetic induction type, and an electromagnetic type. An additional circuit for the wireless charging, for example, a coil loop, a resonant circuit, a rectifier, and the like, may be added.

The battery gauge measures, for example, a residual quantity of the battery 296 and a voltage, current, and temperature during charging. The battery 296 stores or generates electricity and supplies power to the electronic device 201 by using the stored or generated electricity. The battery 296 may include a rechargeable battery or a solar battery.

The indicator 297 indicates a specific state, for example, a booting state, a message state, a charging state, and the like, of the electronic device 201 or a part thereof (e.g., the AP 210).

The motor 298 converts an electric signal into a mechanical vibration.

The electronic device 201 includes a processing unit (e.g., a GPU) for supporting mobile TV. The processing unit for supporting mobile TV processes media data according to a protocol of, for example, digital multimedia broadcasting (DMB), digital video broadcasting (DVB), mediaflo, and the like.

Each of the aforementioned elements of the electronic device 201 may consist of one or more components, and names thereof may vary depending on a type of the electronic device 201. The electronic device 201 may include at least one of the aforementioned elements. Some of the elements may be omitted, or additional other elements may be further included. In addition, some of the elements of the electronic device 201 may be combined and constructed as one entity, so as to equally perform functions of corresponding elements before combination.

At least some parts of a device (e.g., modules or functions thereof) or method (e.g., operations) may be implemented with an instruction stored in a non-transitory computer-readable storage media for example. The instruction may be executed by the processor 210, to perform a function corresponding to the instruction. The non-transitory computer-readable storage media may be, for example, the memory 230. At least some parts of the programming module may be implemented (e.g., executed), for example, by the processor 210. At least some parts of the programming module may include modules, programs, routines, sets of instructions, processes, and the like, for performing one or more functions.

Figure 3:
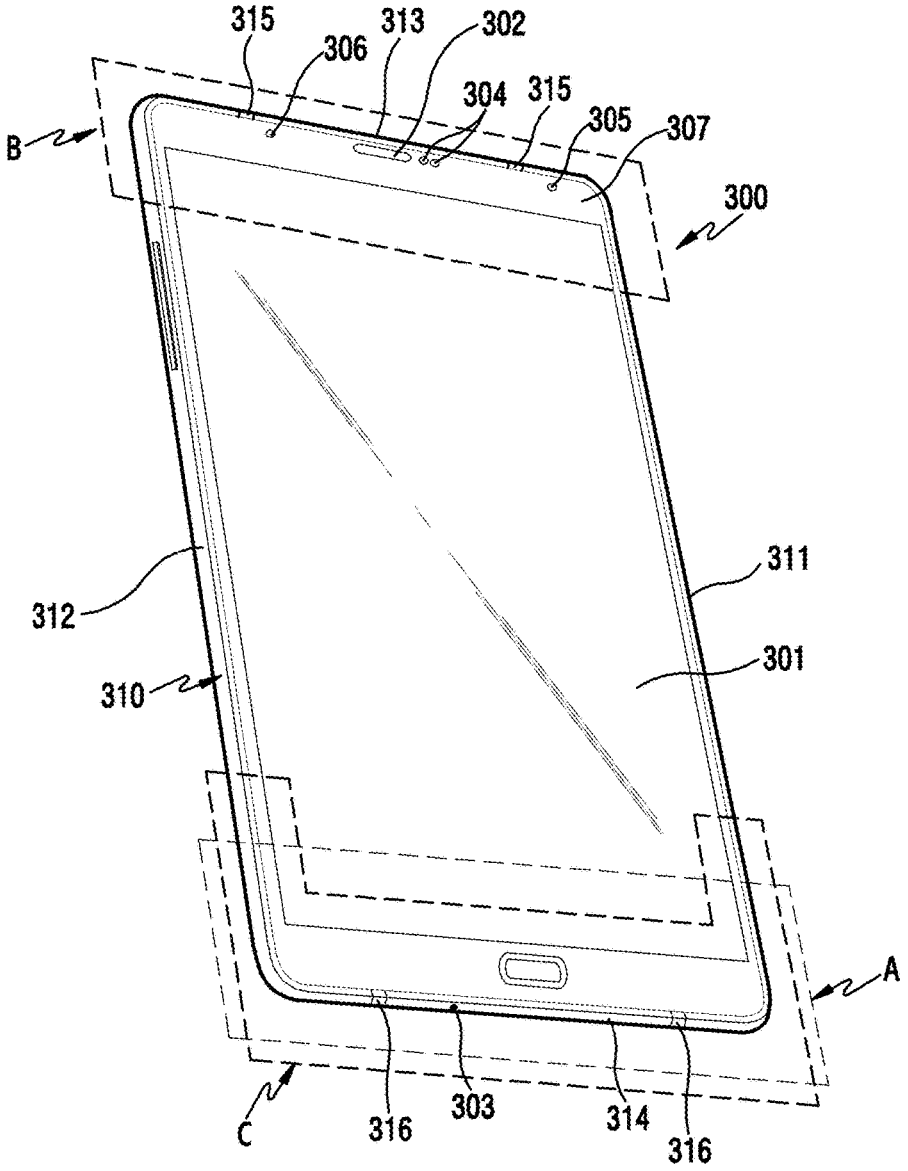
FIG. 3 is a perspective view of an electronic device according to various embodiments of the present disclosure.

FIG. 3 is a perspective view of an electronic device 300 according to various embodiments of the present disclosure.

Referring to FIG. 3, a display 301 may be installed on the front 307 of the electronic device 300. A speaker device 302 for emitting sound may be installed on the upper side of the display 301. A microphone device 303 for transmitting sound may be installed on the lower side of the display 301.

According to an embodiment of the present disclosure, components for performing various functions of the electronic device 300 may be arranged around the speaker device 302. The components may include at least one sensor module 304. The sensor module 304 may include, for example, at least one of an illuminance sensor (e.g., an optical sensor), a proximity sensor, an infrared sensor, and an ultrasonic sensor. The components may also include a camera device 305. The components may also include an LED indicator 306 for informing the user of state information of the electronic device 300.

According to various embodiments of the present disclosure, the electronic device 300 may include a conductive member 310. For example, the conductive member 310 may be disposed, as a part, in at least one area of a metal housing or within the metal housing. The conductive member 310 may be disposed along the outer periphery of the electronic device 300, and may also extend to at least one area of the back of the electronic device 300, which is connected to the outer periphery of the electronic device 300. The conductive member 310 may define the thickness of the electronic device along the outer periphery of the electronic device 300 and may be formed in a loop shape. Without being limited thereto, however, the conductive member 310 may also be formed in such a manner that the conductive member 310 contributes to at least a part of the thickness of the electronic device 300. The conductive member 310 may also be disposed only in at least one area of the outer periphery of the electronic device 300. The conductive member 310 may include one or more cut-off portions 315 and 316. Unit conductive members separated by the cut-off portions 315 and 316 may be used as antenna radiators that operate in at least one frequency band.

According to various embodiments of the present disclosure, the conductive member 310 may have a loop shape along the outer periphery of the electronic device 300, and may be disposed to serve as the entire or a part of the thickness of the electronic device 300. When the electronic device 300 is viewed from the front, the conductive member 310 may include a right conductive member 311, a left conductive member 312, an upper conductive member 313, and a lower conductive member 314. The lower conductive member 314 may serve as a unit conductive member that is formed by a pair of cut-off portions 316.

According to various embodiments of the present disclosure, an antenna device may be disposed on the lower side (in region A) of the electronic device 300. The lower conductive member 314 may be used as an antenna radiator due to the pair of cut-off portions 316. The lower conductive member 314 may serve as an antenna radiator that operates in at least two operating frequency bands according to the power supply position.

According to various embodiments of the present disclosure, the right conductive member 311 may be used as an antenna radiator. By grounding a position of the right conductive member 311 that is separated a predetermined distance from the power supply position of the right conductive member 311, the right conductive member 311 may be used as an antenna radiator that operates in a desired frequency band. The left conductive member 312 may also be used as a parasitic antenna radiator through coupling with the lower conductive member 314, serving as an antenna radiator, in order to help enhance radiation efficiency. Without being limited thereto, however, the left conductive member 312 may be used as an antenna radiator, and the right conductive member 311 may be used as a parasitic antenna radiator that assists the antenna radiator.

According to various embodiments of the present disclosure, the lower conductive member 314 may also be used as a sensing member rather than an antenna radiator as the lower conductive member 314 is formed of a conductive material. The lower conductive member 314 may be used as a grip sensor for detecting whether the user is holding the electronic device with his/her hand. The lower conductive member 314 may also be used as an electrocardiogram sensor, a general touch sensor, a temperature sensor (e.g., a probe for a temperature sensor), or an underwater recognition sensor (e.g., a flooding recognition sensor).

According to various embodiments of the present disclosure, the antenna device is merely for illustrative purpose, and the aforementioned functions of the lower conductive member 314 and the right conductive member 311 may be performed by the upper conductive member 313, separated by the other cut-off portions 315, instead of, or together with, the lower and right conductive members. In this case, region B of FIG. 3 may be used as an antenna device. Also, the lower conductive member separated by other cut-off portions formed in the right conductive member 311 and/or the left conductive member 312 of the conductive member 310 of FIG. 3, which includes at least a part of the right and/or left conductive member in region C, may be used as an antenna radiator.

According to various embodiments of the present disclosure, the lower conductive member 314, which is separated as a unit conductive member by the pair of cut-off portions 316, may be used as an antenna radiator. The right conductive member 311, separated by each cut-off portion 316, may also be used as an antenna radiator.

According to various embodiments of the present disclosure, the ground piece of the right conductive member 311 may be physically connected with the ground piece of the lower conductive member 314 so that the resonant length of the right conductive member 311, used as an antenna radiator, may vary. The operating frequency band of the right conductive member 311 may shift upward from a low frequency band to a high frequency band due to the varied resonant length of the right conductive member 311.

According to various embodiments of the present disclosure, the ground piece of the right conductive member 311 is connected with the ground piece of the lower conductive member 314 in a capacitive type structure using coupling (to operate as a short circuit) so that it is possible to shift the operating frequency band of the right conductive member 311, operating as an antenna radiator, to a high frequency band. Further, when the lower conductive member 314 is used as a sensing member, the lower conductive member 314 may perform a sensing function (e.g., a grip sensing function, an electrocardiogram sensing function, a general touch sensing function, a temperature sensing function, an underwater recognition sensing function, etc.) because only the lower conductive member 314 operates and the right conductive member 311, connected with the lower conductive member 314 in the capacitive type structure, does not operate (to operate as an open circuit). The lower conductive member 314 and the right conductive member 311 may prevent the danger of an electric shock caused by a leakage current (to operate as an open circuit) because the lower conductive member 314 and the right conductive member 311 are connected to each other in the capacitive type structure.

According to various embodiments of the present disclosure, when a working frequency for a first function is applied, the lower conductive member 314 may operate as a short circuit that is connected with the right conductive member 311 by a coupling structure. The first function may include a communication function using a low frequency band and/or a mid frequency band.

According to various embodiments of the present disclosure, when a working frequency for a second function is applied, the right conductive member 311 may operate as a short circuit connected with the lower conductive member 314 by the coupling structure. The second function may include a communication function using a high frequency band.

According to various embodiments of the present disclosure, when a working frequency for a third function (e.g., a sensing function that uses the lower conductive member as a probe, a DC filter function due to the capacitance of the cut-off portion, etc.) is applied, the lower conductive member 314 may operate as an open circuit that is separated from the right conductive member 311 by the coupling structure.

Hereinafter, an antenna device will be described in detail.

Figure 4A:
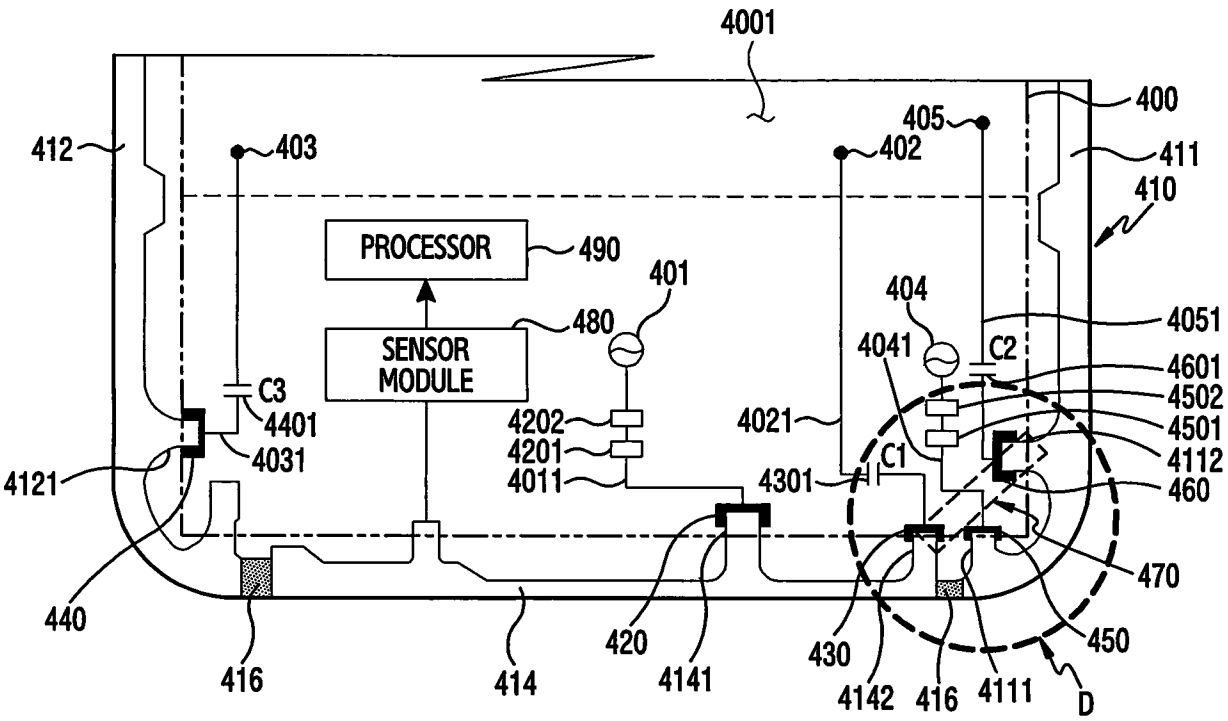
FIG. 4A illustrates the configuration of an antenna device according to various embodiments of the present disclosure.

FIG. 4A illustrates the configuration of the antenna device, according to various embodiments of the present disclosure.

A conductive member 410 of FIG. 4A is an example of a conductive member that is similar to, or different from, the conductive member 310 of FIG. 3.

Referring to FIG. 4A, the conductive member 410 includes a right conductive member 411, a left conductive member 412, and a lower conductive member 414 (an upper conductive member being omitted) when viewed from the front. According to an embodiment of the present disclosure, the lower conductive member 414 may be separated from the right conductive member 411 and the left conductive member 412 by a pair of cut-off portions 416 that are formed with a predetermined interval therebetween. The pair of cut-off portions 416 may be formed of a dielectric material. The pair of cut-off portions 416 may be formed in such a manner that a material formed of a synthetic resin is double-injection molded, or insert molded, into a metal conductive member. Without being limited thereto, however, various types of materials that provide electrical insulation may be applied to the pair of cut-off portions 416.

According to various embodiments of the present disclosure, a first power supply piece 4141 may be integrally formed with the lower conductive member 414 and may be supplied with power by a first power supply unit 401 of a PCB 400. The first power supply piece 4141 of the lower conductive member 414 may be connected to the first power supply unit of the PCB 400 by installing the PCB 400 in the electronic device, or may be electrically connected to the first power supply unit by a separate electrical connection member (e.g., a C-clip, etc.).

According to various embodiments of the present disclosure, a first power supply pad 420 may be mounted on the PCB 400, and the first power supply pad 420 may be electrically connected with the first power supply piece 4141 of the lower conductive member 414. A first electrical path (e.g., a wire line) 4011 may be formed from the first power supply pad 420 to the first power supply unit 401. An electric-shock prevention circuit 4201 for preventing an electric shock and discharging static electricity and a matching circuit 4202 for tuning an antenna radiator to a desired frequency band may be provided on the first electrical path 4011. The electric-shock prevention circuit 4201 may be provided to prevent an electric shock because the first power supply pad 420 of the PCB 400 makes physical contact with the conductive member 410 that forms the exterior of the electronic device.

According to various embodiments of the present disclosure, a first ground piece 4142 may be integrally formed with the lower conductive member 414 so as to be spaced a predetermined distance apart from the first power supply piece 4141 and may be connected to a first ground portion 402 of the PCB 400. The first ground piece 4142 of the lower conductive member 414 may be connected to the first ground portion 402 of the PCB 400 by installing the PCB 400 in the electronic device, or may be electrically connected to the first ground portion by the separate electrical connection member.

According to various embodiments of the present disclosure, a first ground pad 430 may be mounted on the PCB 400, and the first ground pad 430 may be electrically connected with the first ground piece 4142 of the lower conductive member 414. A second electrical path (e.g., a wire line) 4021 may be formed from the first ground pad 430 to the first ground portion 402. A first electric-shock prevention circuit 4301 (e.g., a capacitor) for preventing an electric shock and discharging static electricity may be provided on the second electrical path 4021 because the first ground pad 430 of the PCB 400 makes physical contact with the conductive member 410 that forms the exterior of the electronic device.

According to various embodiments of the present disclosure, a second ground piece 4121 may be integrally formed with the left conductive member 412 so as to be spaced a predetermined distance apart from the cut-off portion 416, and may be connected to a second ground portion 403 of the PCB 400. The second ground piece 4121 of the left conductive member 412 may be connected to the second ground portion 403 of the PCB 400 by installing the PCB 400 in the electronic device, or may be electrically connected to the second ground portion by the separate electrical connection member.

According to various embodiments of the present disclosure, a second ground pad 440 may be mounted on the PCB 400, and the second ground pad 440 may be electrically connected with the second ground piece 4121 of the left conductive member 412. A third electrical path (e.g., a wire line) 4031 may be formed from the second ground pad 440 to the second ground portion 403. A second electric-shock prevention circuit 4401 (e.g., a capacitor) for preventing an electric shock and discharging static electricity may be provided on the third electrical path 4031 because the second ground pad 440 of the PCB 400 makes physical contact with the conductive member 410 that forms the exterior of the electronic device.

According to various embodiments of the present disclosure, a second power supply piece 4111 may be integrally formed with the right conductive member 411 and may be supplied with power by a second power supply unit 404 of the PCB 400. The second ground piece 4111 of the right conductive member 411 may be connected to the second power supply unit 404 of the PCB 400 by installing the PCB 400 in the electronic device, or may be electrically connected to the second power supply unit by the separate electrical connection member.

According to various embodiments of the present disclosure, a second power supply pad 450 may be mounted on the PCB 400, and the second power supply pad 450 may be electrically connected with the second power supply piece 4111 of the right conductive member 411. A fourth electrical path (e.g., a wire line) 4041 may be formed from the second power supply pad 450 to the second power supply unit 404. An electric-shock prevention circuit 4501 for preventing an electric shock and discharging static electricity and a matching circuit 4502 for tuning an antenna radiator to a desired frequency band may be provided on the fourth electrical path 4041. The electric-shock prevention circuit 4501 may prevent an electric shock because the second power supply pad 450 of the PCB 400 makes physical contact with the conductive member 410 that forms the exterior of the electronic device.

According to various embodiments of the present disclosure, a third ground piece 4112 may be integrally formed with the right conductive member 411 so as to be spaced a predetermined distance apart from the second power supply piece 4111 and may be connected to a third ground portion 405 of the PCB 400. The third ground piece 4112 of the right conductive member 411 may be connected to the third ground portion 405 of the PCB 400 by installing the PCB 400 in the electronic device, or may be electrically connected to the third ground portion by the separate electrical connection member.

According to various embodiments of the present disclosure, a third ground pad 460 may be mounted on the PCB 400, and the third ground pad 460 may be electrically connected with the third ground piece 4112 of the right conductive member 411. A fifth electrical path (e.g., a wire line) 4051 may be formed from the third ground pad 460 to the third ground portion 405. A third electric-shock prevention circuit 4601 (e.g., a capacitor) for preventing an electric shock and discharging static electricity may be provided on the fifth electrical path 4051 because the third ground pad 460 of the PCB 400 makes physical contact with the conductive member 410 that forms the exterior of the electronic device.

According to various embodiments of the present disclosure, the right conductive member 411 electrically connected with the second power supply unit 404 may operate as an antenna radiator that has an electrical length that extends to the first ground piece 4142 through the second power supply pad 450, the second power supply piece 4111, the third ground piece 4112, and the PCB 400 (e.g., the pattern of the PCB). The right conductive member 411 may operate as the antenna radiator having the aforementioned electrical length, but it may not operate the right conductive member 411 in a relatively high operating frequency band because the physical length of the right conductive member 411 and the length of the pattern formed on the PCB 400 are all applied as the electrical length for the antenna radiator.

In various embodiments of the present disclosure, the electrical length may be designed to be as short as possible such that the operating frequency band is shifted from a low frequency band to a high frequency band. An electrical connection member 470 may be applied in order to directly connect the first ground piece 4142 of the lower conductive member 414 and the third ground piece 4112 of the right conductive member 411. The electrical connection member 470 may be, for example, a member that electrically connects the two ground pieces 4142 and 4112. The electrical connection member 470 may be a capacitive type connection method in which coupling is possible with a predetermined gap, rather than a direct electrical contact, between the electrical connection member 470 and at least one of the ground pieces 4142 and 4112. Due to the coupling structure of the electrical connection member 470, the first ground piece 4142 of the lower conductive member 414 may operate as a short circuit while being capacitively connected with the third ground piece 4112 when the right conductive member 411 is used to transmit and receive RF signals for an antenna radiator that operates in a high frequency band. Due to the coupling structure of the electrical connection member 470, the first ground piece 4142 of the lower conductive member 414 may operate as an open circuit that is electrically disconnected from the third ground piece 4112 of the right conductive member 411 when the lower conductive member 414 operates in a low frequency band for optimization of a grip sensor and a leakage current.

According to various embodiments of the present disclosure, the aforementioned electrical connection member 470 may include one or more of various members, such as a thin film antenna (TFA), a flexible printed circuit board (FPCB), a thin cable (e.g., a metal wire), a conductive gasket, a thin metal plate, etc. For example, in a case where a TFA or a flexible printed circuit board is used, at least one of the first and third ground pieces 4142 and 4112 may be directly secured, and electrically connected, to an exposed metal pattern of the TFA or the flexible printed circuit board. In this case, the TFA or the flexible printed circuit board may be secured to the ground piece through soldering, a conductive tape, welding, a conductive clip, conductive bonding, etc.

According to various embodiments of the present disclosure, a sensor module 480, which is controlled by a processor 490 of the electronic device, may be electrically connected with the lower conductive member 414. The lower conductive member 414 may also be used as a sensing member, rather than an antenna radiator or a parasitic antenna radiator.

According to various embodiments of the present disclosure, the sensor module 480 may include a grip sensor (e.g., the lower conductive member 414) that detects whether a user is holding the electronic device. In a case where the sensor module is used as a grip sensor module and the grip sensor operates by a human body's access to the electronic device, the processor 490 may determine that the human body has accessed the electronic device and may operate to automatically reduce the power to a level (specific absorption rate (SAR)) that is not harmful to the human body (SAR power limit backoff). In a case where the sensor module is used as a grip sensor module and the grip sensor operates by a human body's access to the electronic device, the processor 490 may determine that the human body has accessed the electronic device and may control an antenna tuner or a tuning switch in order to set the resonant frequency of the antenna device, the performance of which is degraded, to the frequency band in which the electronic device performs communication. The processor 490, when detecting a human body's access, may use another antenna that the human body does not access. For example, in a case where a human body's access to a lower antenna of the electronic device is detected, the processor may control the electronic device to transmit a signal through an antenna disposed on the upper side thereof other than the lower antenna of the electronic device.

According to various embodiments of the present disclosure, the sensor module may also include an electrocardiogram sensor (e.g., the lower conductive member 414) for checking the heart rate of a human body.

According to various embodiments of the present disclosure, the sensor module may also include a temperature sensor (e.g., the lower conductive member 414) in which the lower conductive member 414 serves as a temperature sensor probe.

According to various embodiments of the present disclosure, the sensor module may also include an underwater recognition sensor (flooding recognition sensor) (e.g., the lower conductive member 414) that detects the permittivity of liquid to identify whether the electronic device is under water.

Figure 4B:
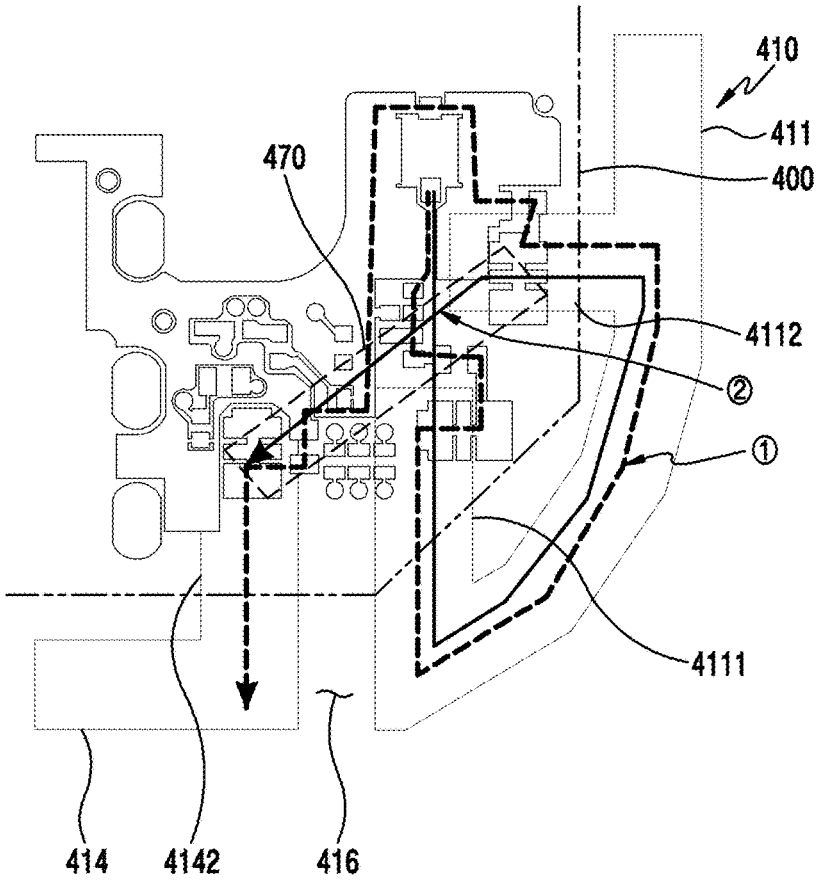
FIG. 4B is an enlarged view of region D of FIG. 4A, according to various embodiments of the present disclosure.

FIG. 4B is an enlarged view of region D of FIG. 4A, according to various embodiments of the present disclosure.

If the first and third ground pieces 4142 and 4112 are directly connected by the electrical connection member 470, the connection path of the antenna radiator of the right conductive member 411 that is feed-connected to the second power supply piece 4111 may become shorter, and the right conductive member 411 may operate as an antenna radiator in a desired high frequency band accordingly.

According to various embodiments of the present disclosure, the existing path electrically connected through the ground portions 402 and 405 of the PCB 400 may be formed to have a loop area similar to ① of FIG. 4B. However, if the first and third ground pieces 4142 and 4112 are directly connected by the electrical connection member 470, the path may be formed to have a loop area similar to ② of FIG. 4B. Since the electrical path ② is formed to be shorter than the electrical path ①, the operating frequency band of the right conductive member 411, used as an antenna radiator, may be easily shifted from the existing frequency band to a higher frequency band.

Figure 5:
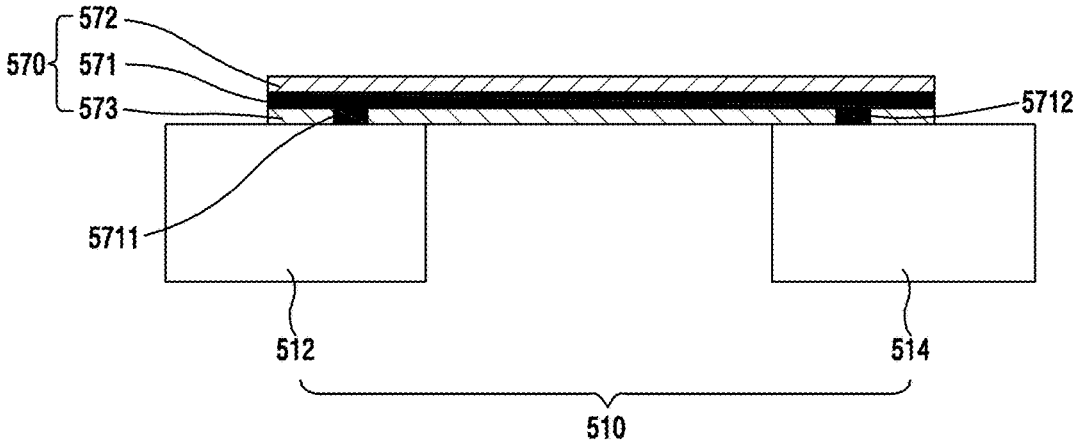
FIG. 5 is a sectional view of major parts of a coupling structure between two conductive members, according to various embodiments of the present disclosure.

FIG. 5 is a sectional view of major parts of a coupling structure between two conductive members, according to various embodiments of the present disclosure.

A conductive member 510 of FIG. 5 is an example of a conductive member that is similar to, or different from, the first ground piece 4142 of the lower conductive member 414 and the second ground piece 4112 of the right conductive member 411 of the conductive member 410 of FIG. 4A.

According to various embodiments of the present disclosure, the conductive member 510 may include a first conductive member 512 and a second conductive member 514. The first and second conductive members 512 and 514 spaced apart from each other may be electrically connected to each other. For example, the first and second conductive members 512 and 514 may be electrically connected to each other by an electrical connection member 570 (e.g., a TFA, an FPCB, etc.).

According to various embodiments of the present disclosure, the first conductive member 512 may be a conductive member that is similar to, or different from, the first ground piece 4142 of the lower conductive member 414 of FIG. 4A, which is used as an antenna radiator and a sensor member. The second conductive member 514 may be a conductive member that is similar to, or different from, the second ground piece 4112 of the right conductive member 411 of FIG. 4A.

According to various embodiments of the present disclosure, an FPCB that includes a metal layer 571 may be used as the electrical connection member 570. The electrical connection member 570 may be disposed in such a manner that one end thereof is stacked on the top of the first conductive member 512 and the other end is stacked on the top of the second conductive member 514. The electrical connection member 570 may be disposed in such a manner that the metal layer 571 is interposed between an insulating film 572 and an insulating double-sided tape 573. The electrical connection member 570 may be attached to both one surface (e.g., the top) of the first conductive member 512 and one surface (e.g., the top) of the second conductive member 514 by the insulating double-sided tape 573.

According to various embodiments of the present disclosure, an exposed area 5711 of the metal layer 571 may make direct electrical contact with the first conductive member 512 while passing through the insulating double-sided tape 573. An exposed area 5712 of the metal layer 571 may make direct electrical contact with the second conductive member 514 while passing through the insulating double-sided tape 573. The exposed areas 5711 and 5712 may be electrically connected with the first conductive member 512 through soldering, a conductive tape, welding, a conductive clip, conductive bonding, etc.

According to various embodiments of the present disclosure, the electrical length may be formed to be shorter by directly connecting the first conductive member 512 (e.g., the first ground piece 4142 of the lower conductive member 414 of FIG. 4A) and the second conductive member 514 (e.g., the third ground piece 4112 of the right conductive member 411 of FIG. 4A), as described above, so that the frequency is shifted toward a high frequency band when the first or second conductive member is used as an antenna radiator.

Figure 6A:
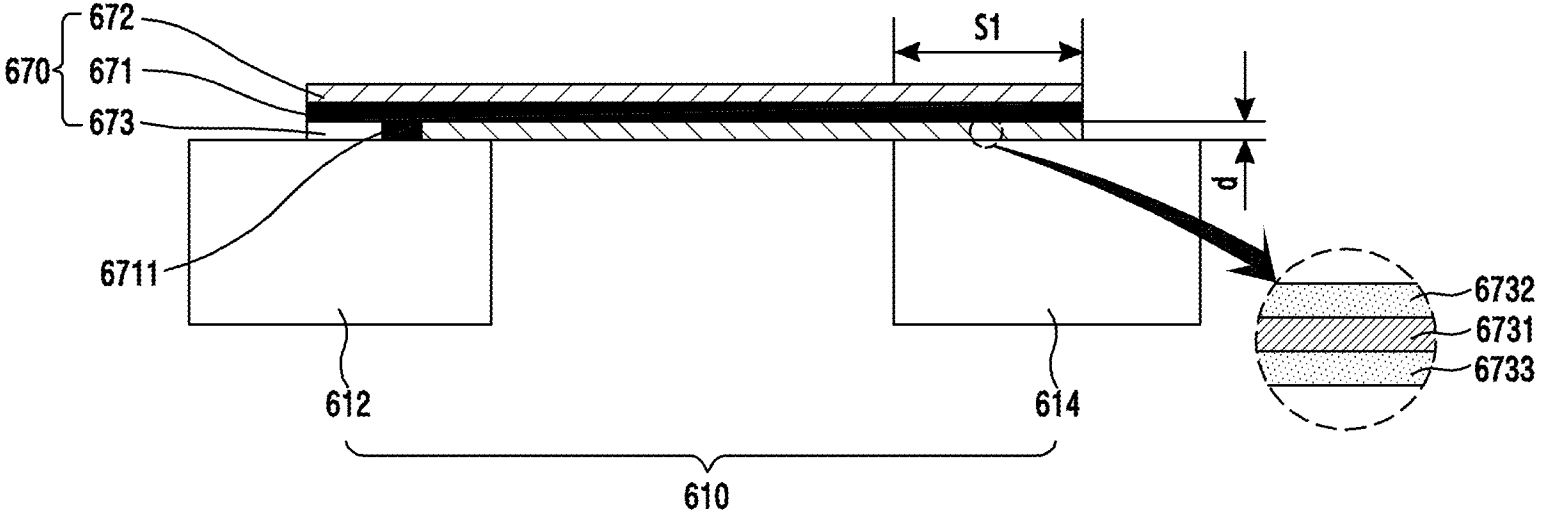
FIGS. 6A and 6B are sectional views of major parts of a coupling structure between two conductive members, according to various embodiments of the present disclosure.
Figure 6B:
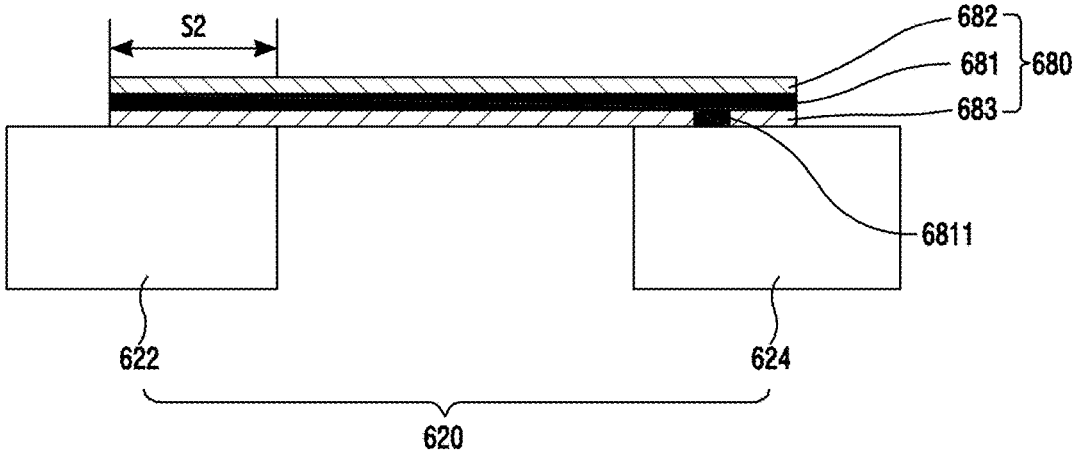

FIGS. 6A and 6B are sectional views of major parts of a coupling structure between two conductive members, according to various embodiments of the present disclosure.

Referring to FIG. 6A, a conductive member 610 is an example of a conductive member that is similar to, or different from, the first ground piece 4142 of the lower conductive member 414 and the second ground piece 4112 of the right conductive member 411 of the conductive member 410 of FIG. 4A.

Referring to FIG. 4A, when the lower conductive member 414, the right conductive member 411, and the left conductive member 412 are directly electrically connected to each other, the effective capacitance of the circuit for the sensor module 480 may increase from C1 to C1+C2+C3. Further, the parasitic capacitance of each conductive member may also be added. When the total capacitance value is beyond the operating capacitance range of the sensor module, the IC of the sensor module 480 may be saturated so that it fails to detect a variation in capacitance, and the grip sensor may not operate accordingly. Further, although only the lower conductive member 414 may operate as a grip sensor, the right conductive member 411 and/or the left conductive member 412 may also operate as a grip sensor, thereby causing a malfunction.

According to various embodiments of the present disclosure, in a case where an external isolated charging source (e.g., an isolated travel adaptor (TA)) is used, a device has to be designed such that a leakage current more than a predetermined value is not detected through the ground portion of the device. However, in a case where cut-off portions are electrically connected to each other, the currents of conductive members are added, which may cause the danger of an electric shock.

Hereinafter, a method for solving the problem will be described in detail with reference to the drawings.

Referring to FIG. 6A, the conductive member 610 may include a first conductive member 612 and a second conductive member 614. According to an embodiment of the present disclosure, the first and second conductive members 612 and 614 spaced apart from each other may be electrically connected to each other. For example, the first and second conductive members 612 and 614 may be capacitively connected to each other by an electrical connection member 670 (e.g., a TFA, an FPCB, etc.).

According to various embodiments of the present disclosure, the first conductive member 612 may be a conductive member that is similar to, or different from, the first ground piece 4142 of the lower conductive member 414 of FIG. 4A, which is used as an antenna radiator and a sensor member. The second conductive member 614 may be a conductive member that is similar to, or different from, the second ground piece 4112 of the right conductive member 411 of FIG. 4A.

According to various embodiments of the present disclosure, a TFA or FPCB that includes a metal layer 671 may be used as the electrical connection member 670. The electrical connection member 670 may be disposed in such a manner that one end is stacked on the top of the first conductive member 612 and the other end is stacked on the top of the second conductive member 614. The electrical connection member 670 may be disposed in such a manner that the metal layer 671 is interposed between an insulating film 672 and an insulating double-sided tape 673. The electrical connection member 670 may be attached to both one surface (e.g., the top) of the first conductive member 612 and one surface (e.g., the top) of the second conductive member 614 by the insulating double-sided tape 673.

According to various embodiments of the present disclosure, the insulating double-sided tape 673 may include a poly-ethylene terephthalate (PET) film layer 6731 and acrylic layers 6732 and 6733 that are stacked on the top and bottom of the PET film layer 6731 and are spaced apart from each other as a bonding layer. A releasing film layer (e.g., a PET liner) may be stacked on each of the acrylic layers 6732 and 6733. The releasing film layers may be removed in order to expose the acrylic layers 6732 and 6733, serving as a bonding layer, when the FPCB 670 is applied for the electrical connection between the two conductive members 612 and 614.

According to various embodiments of the present disclosure, an exposed area 6711 of the metal layer 671 may make direct electrical contact with the first conductive member 612 while passing through the insulating double-sided tape 673. The exposed area 6711 may be electrically connected with the first conductive member 612 through soldering, a conductive tape, welding, a conductive clip, conductive bonding, etc. The metal layer 671 of the electrical connection member 670 may not make physical contact with the second conductive member 614 due to the insulating double-sided tape 673, and may be disposed where coupling is possible therebetween with coupling area S1. Accordingly, the first and second conductive members 612 and 614 may be electrically connected to each other by the electrical connection member 670 with no direct contact. The capacitance value may be determined based on the material or thickness of the insulating double-sided tape 673 that is disposed between the second conductive member 614 and the metal layer 671.

Referring to FIG. 6B, a conductive member 620 is an example of a conductive member that is similar to, or different from, the first ground piece 4142 of the lower conductive member 414 and the second ground piece 4112 of the right conductive member 411 of the conductive member 410 of FIG. 4A.

According to various embodiments of the present disclosure, the conductive member 620 may include a first conductive member 622 and a second conductive member 624. The first and second conductive members 622 and 624 spaced apart from each other may be electrically connected to each other. For example, the first and second conductive members 622 and 624 may be capacitively connected to each other by an electrical connection member 680 (e.g., a TFA, an FPCB, etc.).

According to various embodiments of the present disclosure, a TFA or FPCB that includes a metal layer 681 may be used as the electrical connection member 680. The electrical connection member 680 may be disposed in such a manner that one end thereof is stacked on the top of the first conductive member 622 and the other end is stacked on the top of the second conductive member 624. The electrical connection member 680 may be disposed in such a manner that the metal layer 681 is interposed between an insulating film 682 and an insulating double-sided tape 683. The electrical connection member 680 may be attached to both one surface (e.g., the top) of the first conductive member 622 and one surface (e.g., the top) of the second conductive member 624 by the insulating double-sided tape 683.

According to various embodiments of the present disclosure, an exposed area 6811 of the metal layer 681 may make direct electrical contact with the second conductive member 624 while passing through the insulating double-sided tape 683. The exposed area 6811 may be electrically connected with the second conductive member 624 through soldering, a conductive tape, welding, a conductive clip, conductive bonding, etc. The metal layer 681 of the electrical connection member 680 may not make physical contact with the first conductive member 622 due to the insulating double-sided tape 683, and may be disposed where coupling is possible therebetween with coupling area S2. Accordingly, the first and second conductive members 622 and 624 may be electrically connected to each other by the electrical connection member 680 with no direct contact. The capacitance value may be determined based on the material or thickness of the insulating double-sided tape 683 that is disposed between the first conductive member 624 and the metal layer 681.

According to various embodiments of the present disclosure, the insulating double-sided tape 683 may be an insulating double-sided tape that is similar to, or different from, the insulating double-sided tape 673 of FIG. 6A.

Figure 6C:
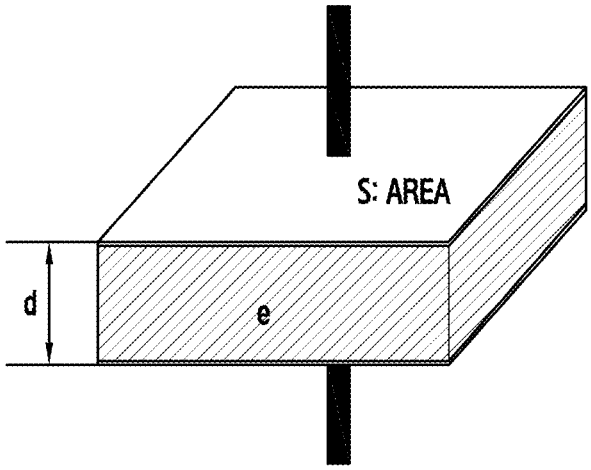
FIG. 6C is a schematic diagram for the calculation of the capacitance for a dielectric material between two metal plates, according to various embodiments of the present disclosure.

FIG. 6C is a schematic diagram for the calculation of the capacitance for a dielectric material between two metal plates, according to various embodiments of the present disclosure. FIG. 6C is a diagram for the calculation of the capacitance value through coupling between the two metal objects.

Referring to FIG. 6C, the area S of the two metal plates may be calculated by Equation (1) below using the permittivity of the dielectric material (e.g., air, an insulating double-sided tape, etc.) between the two metal plates (e.g., a metal layer and a conductive member), the distance between the plates and the capacitance C.

$$C = \varepsilon \frac{S}{d} \tag{1}$$

where C denotes the capacitance between the two metal plates, S denotes the area of the metal plates, d denotes the separation distance between the metal plates, and $\in$ equals to $\in r \times \in 0$ ($\in r$ is a dielectric constant and $\in 0 = 8.854 \times 10^{-12}$). The desired capacitance C may also be calculated in consideration of the relation in which the capacitance C is inversely proportional to the separation distance d between the two metal plates and is proportional to the area S of the plates. Accordingly, it is possible to vary the capacitance C by modifying the superposition area (e.g., S1 or S2) of the two metal plates, the separation distance d, or the permittivity of the dielectric material.

According to various embodiments of the present disclosure, since at least a part of the metal layer of the electrical connection member is disposed so as to have a predetermined coupling area with the first or second conductive member as described above, the second conductive member is capacitively connected with the first conductive member when operating as an antenna radiator so that the operating frequency band may be shifted to a high frequency band. When the first conductive member is used as a grip sensor (or a member for optimizing a leakage current) in a low frequency band, the first conductive member is not electrically connected with the second conductive member, which may prevent a malfunction of the corresponding function.

Figure 7:
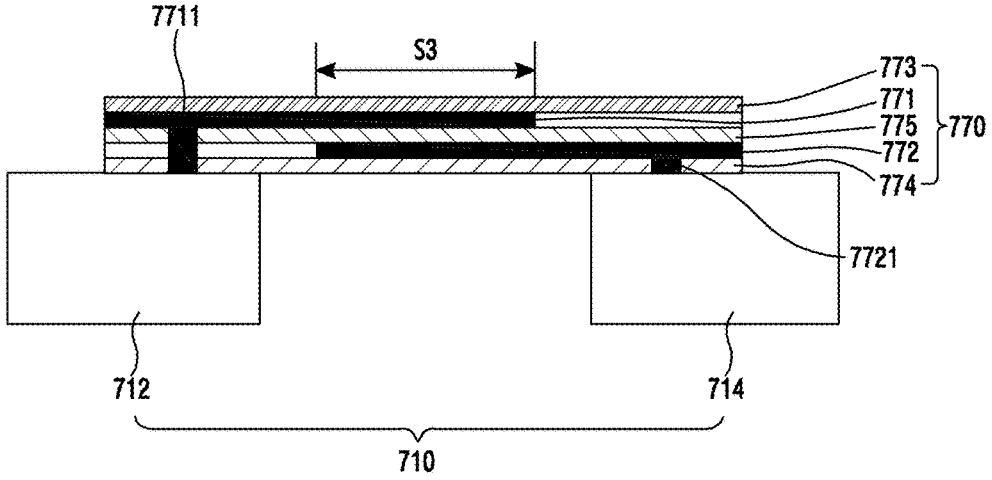
FIG. 7 is a sectional view of major parts of a coupling structure between two conductive members, according to various embodiments of the present disclosure.

FIG. 7 is a sectional view of major parts of an electrical coupling structure between two conductive members, according to various embodiments of the present disclosure.

A conductive member 710 of FIG. 7 is an example of a conductive member that is similar to, or different from, the first ground piece 4142 of the lower conductive member 414 and the second ground piece 4112 of the right conductive member 411 of the conductive member 410 of FIG. 4A.

According to various embodiments of the present disclosure, the conductive member 710 may include a first conductive member 712 and a second conductive member 714. The first and second conductive members 712 and 714 spaced apart from each other may be electrically connected to each other. For example, the first and second conductive members 712 and 714 may be capacitively connected to each other by an electrical connection member 770 (e.g., a TFA, an FPCB, etc.).

According to various embodiments of the present disclosure, the first conductive member 712 may be a conductive member that is similar to, or different from, the first ground piece 4142 of the lower conductive member 414 of FIG. 4A, which is used as an antenna radiator and a sensor member. The second conductive member 714 may be a conductive member that is similar to, or different from, the third ground piece 4112 of the right conductive member 411. Without being limited thereto, however, the second conductive member 714 may be a conductive member that is similar to, or different from, the lower conductive member 414 of FIG. 4A, which is used as an antenna radiator and a sensor member, and the first conductive member 712 may be a conductive member that is similar to, or different from, the right conductive member 411 or the left conductive member 412, which is electrically connected with the lower conductive member 414 of FIG. 4A through coupling.

According to various embodiments of the present disclosure, the electrical connection member 770 may include an FPCB that includes two metal layers 771 and 772 spaced apart from each other. The electrical connection member 770 may be disposed in such a manner that one end thereof is stacked on the top of the first conductive member 712 and the other end is stacked on the top of the second conductive member 714. The electrical connection member 770 may be disposed in such a manner that the metal layers 771 and 772 are electrically isolated from each other between an insulating film 773 and an insulating double-sided tape 774 by an insulating layer 775. The electrical connection member 770 may be attached to the tops of the first and second conductive members 712 and 714 by the insulating double-sided tape 774.

According to various embodiments of the present disclosure, an exposed area 7711 of the first metal layer 771 may make direct electrical contact with the first conductive member 712 while passing through the insulating double-sided tape 774 and the insulating layer 775. The exposed area 7711 of the first metal layer 771 may be electrically connected with the first conductive member 712 through soldering, a conductive tape, welding, a conductive clip, conductive bonding, etc. An exposed area 7721 of the second metal layer 772 may make direct electrical contact with the second conductive member 714 while passing through the insulating double-sided tape 774. The exposed area 7721 may be electrically connected with the second conductive member 714 through soldering, a conductive tape, welding, a conductive clip, conductive bonding, etc.

According to an embodiment of the present disclosure, the electrical connection member 770 may not bring the first conductive member 712 into physical contact with the second conductive member 714, and may be disposed where coupling is possible with coupling area S3 larger than the above-described coupling areas. Accordingly, the first and second metal layers 771 and 772 may be disposed so as to have the overlapping coupling area S3. The capacitance value may be determined based on the overlapping area and the material (e.g., permittivity) or thickness of the insulating layer 775 that is disposed between the first and second metal layers 771 and 772.

According to various embodiments of the present disclosure, the insulating double-sided tape 774 may be an insulating double-sided tape that is similar to, or different from, the insulating double-sided tape 673 of FIG. 6A.

Figure 8A:
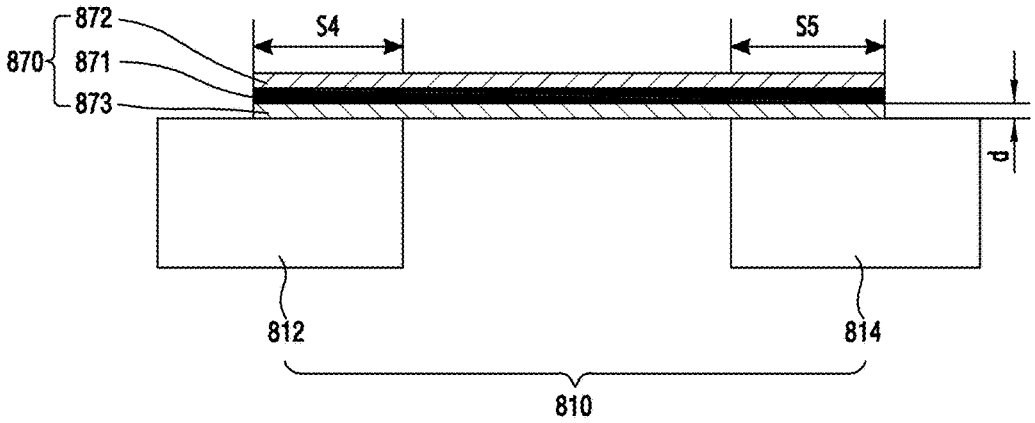
FIGS. 8A and 8B are sectional views of major parts of a coupling structure between two conductive members, according to various embodiments of the present disclosure.
Figure 8B:
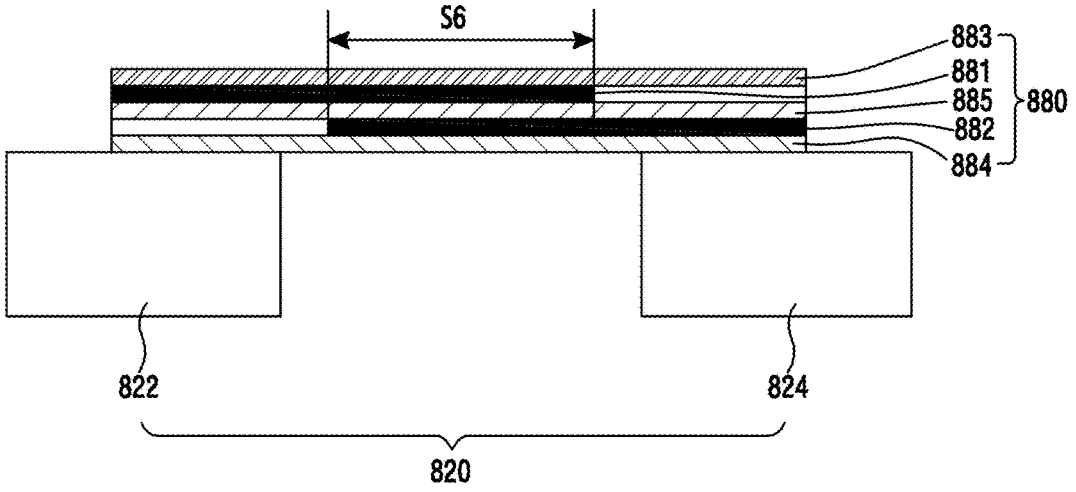

FIGS. 8A and 8B are sectional views of major parts of a coupling structure between two conductive members, according to various embodiments of the present disclosure.

A conductive member 810 of FIG. 8A is an example of a conductive member that is similar to, or different from, the first ground piece 4142 of the lower conductive member 414 and the second ground piece 4112 of the right conductive member 411 of the conductive member 410 of FIG. 4A.

According to various embodiments of the present disclosure, the conductive member 810 may include a first conductive member 812 and a second conductive member 814. The first and second conductive members 812 and 814 spaced apart from each other may be electrically connected to each other. For example, the first and second conductive members 812 and 814 may be capacitively connected to each other by an electrical connection member 870 (e.g., a TFA, an FPCB, etc.).

According to various embodiments of the present disclosure, the first conductive member 812 may be a conductive member that is similar to, or different from, the first ground piece 4142 of the lower conductive member 414 of FIG. 4A, which is used as an antenna radiator and a sensor member. The second conductive member 814 may be a conductive member that is similar to, or different from, the third ground piece 4112 of the right conductive member 411. Without being limited thereto, however, the second conductive member 814 may be a conductive member that is similar to, or different from, the lower conductive member 414 of FIG. 4A, which is used as an antenna radiator and a sensor member, and the first conductive member 812 may be a conductive member that is similar to, or different from, the right conductive member 411 or the left conductive member 412, which is electrically connected with the lower conductive member 414 of FIG. 4A.

According to various embodiments of the present disclosure, a metal layer 871 of the electrical connection member 870 may be disposed so as to not make physical contact with the first and second conductive members 812 and 814 due to an insulating double-sided tape 873. The first conductive member 812 may be disposed so as to have the superposition area S4 with the metal layer 871 of the electrical connection member 870. The second conductive member 814 may be disposed so as to have the superposition area S5 with the metal layer 871 of the electrical connection member 870. The metal layer 871 of the electrical connection member 870 may be spaced apart from the first and second conductive members 812 and 814 by the separation distance d. The capacitance value generated between the electrical connection member 870 and the first and second conductive members 812 and 814 may vary by modifying at least one of the distance d between the metal layer 871 of the electrical connection member 870 and the two conductive members 812 and 814, the superposition areas S4 and S5, and the material (e.g., permittivity) of the insulating double-sided tape 873. The distances d between the two conductive members 812 and 814 and the metal layer 871 are illustrated as being equal to each other, but they are not limited thereto. For example, the distance between one conductive member 812 and the metal layer 871 may differ from that between the other conductive member 814 and the metal layer 871.

According to various embodiments of the present disclosure, the insulating double-sided tape 873 may be an insulating double-sided tape that is similar to, or different from, the insulating double-sided tape 673 of FIG. 6A.

A conductive member 820 of FIG. 8B is an example of a conductive member that is similar to, or different from, the first ground piece 4142 of the lower conductive member 414 and the second ground piece 4112 of the right conductive member 411 of the conductive member 410 of FIG. 4A.

According to various embodiments of the present disclosure, the conductive member 820 may include a first conductive member 822 and a second conductive member 824. The first and second conductive members 822 and 824 spaced apart from each other may be electrically connected to each other. For example, the first and second conductive members 822 and 824 may be capacitively connected to each other by an electrical connection member 880 (e.g., a TFA, an FPCB, etc.).

According to various embodiments of the present disclosure, the first conductive member 822 may be a conductive member that is similar to, or different from, the first ground piece 4142 of the lower conductive member 414 of FIG. 4A, which is used as an antenna radiator and a sensor member. The second conductive member 824 may be a conductive member that is similar to, or different from, the third ground piece 4112 of the right conductive member 411. Without being limited thereto, however, the second conductive member 824 may be a conductive member that is similar to, or different from, the lower conductive member 414 of FIG. 4A, which is used as an antenna radiator and a sensor member, and the first conductive member 822 may be a conductive member that is similar to, or different from, the right conductive member 411 or the left conductive member 412, which is electrically connected with the lower conductive member 414 of FIG. 4A.

According to various embodiments of the present disclosure, the electrical connection member 880 may include a TFA or FPCB that has two metal layers 881 and 882 spaced apart from each other. The electrical connection member 880 may be disposed in such a manner that one end thereof is stacked on the top of the first conductive member 822 and the other end is stacked on the top of the second conductive member 824. The electrical connection member 880 may be disposed in such a manner that the metal layers 881 and 882 are electrically isolated from each other between an insulating film 883 and an insulating double-sided tape 884 by an insulating layer 885. The electrical connection member 880 may be attached to both one surface (e.g., the top) of the first conductive member 822 and one surface (e.g., the top) of the second conductive member 824 by the insulating double-sided tape 884.

According to various embodiments of the present disclosure, the first metal layer 881 may be disposed so as to be electrically isolated from, but electrically connected to, the first conductive member 822 by the insulating layer 885 and the insulating double-sided tape 884. The second metal layer 882 may be disposed so as to be electrically isolated from, but electrically connected to, the second conductive member 824 by the insulating double-sided tape 884. Accordingly, the areas of the first and second metal layers 881 and 882 may serve as the enlarged coupling area S6 because the two metal layers 881 and 882 of the electrical connection member 880 are electrically isolated from, but electrically connected to, the first and second conductive members 822 and 824, respectively. The capacitance value may be determined based on the overlapping area and the thickness or material of the dielectric material (e.g., the insulating layer 885, the insulating double-sided tape 884, the space between the insulating layer 885 and the insulating double-sided tape 884, etc.) that is disposed between the first metal layer 881 and the first conductive member 822. The capacitance value may also be determined based on the thickness or material of the dielectric material (e.g., the insulating double-sided tape 884) that is disposed between the second metal layer 882 and the second conductive member 824.

According to various embodiments of the present disclosure, the insulating double-sided tape 884 may be an insulating double-sided tape that is similar to, or different from, the insulating double-sided tape 673 of FIG. 6A.

Figure 9A:
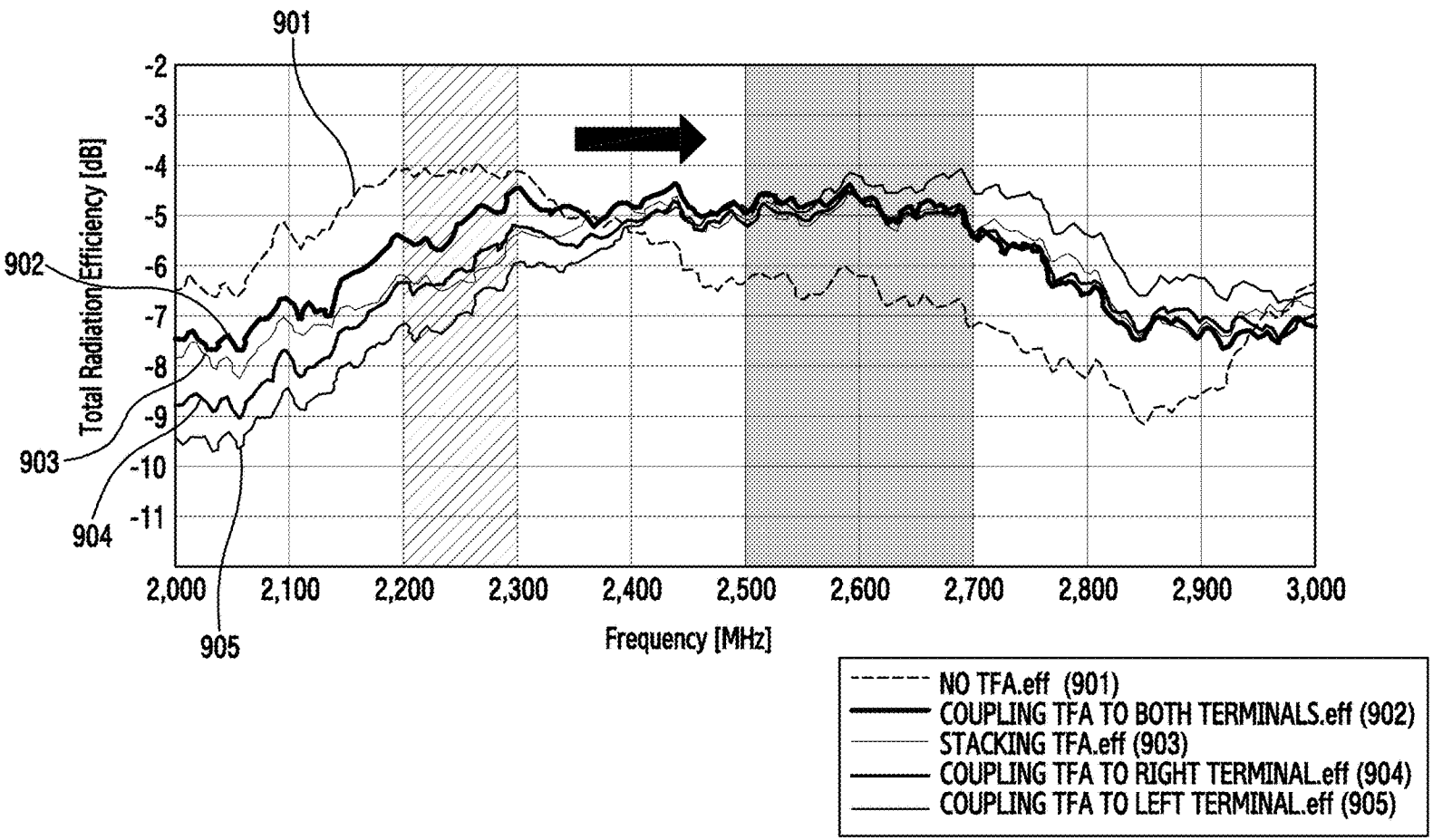

FIGS. 9A and 9B are a graph and a comparison table that represent efficiencies according to coupling structures between two conductive members, according to various embodiments of the present disclosure.

Referring to FIGS. 9A and 9B, reference numeral 901 indicates the graph when no electrical connection member (e.g., a thin film antenna (TFA)) was applied to the two conductive members. Reference numeral 902 indicates the graph when the two conductive members were all directly electrically connected to an electrical connection member. Reference numeral 903 indicates the graph when two conductive layers directly electrically connected to the two conductive members were capacitively connected. Reference numeral 904 indicates the graph when the right conductive member of the two conductive members was directly electrically connected to an electrical connection member and the left conductive member was capacitively connected to the electrical connection member. Reference numeral 905 indicates the graph when the left conductive member of the two conductive members was directly electrically connected to an electrical connection member and the right conductive member was capacitively connected to the electrical connection member.

According to various embodiments of the present disclosure, it may be seen that when no electrical connection member (e.g., thin film antenna (TFA)) was applied, for example, the right conductive member 411 of FIG. 4A, which was used as an antenna radiator, operated in a frequency band ranging from 2200 MHz to 2300 MHz, but when the first ground piece 4142 of the lower conductive member 414 and the third ground piece 4112 of the right conductive member 411 were electrically or capacitively connected to each other through the electrical connection members, the operating frequency band shifted to a high frequency band ranging from 2500 MHz to 2700 MHz. In addition, it may be seen that when the electrical connection members, according to the various embodiments, were applied, a relatively good gain of −4.51 dBi to −4.95 dBi was obtained, but when no electrical connection member was applied, a relatively low gain of −6.45 dBi on the average was obtained.

According to various embodiments of the present disclosure, the operating frequency band may be adjusted according to a method of connecting an electrical connection member (e.g., directly connecting two terminals through an electrical connection member, capacitively connecting an electrical connection member with one terminal, etc.), and a gain for each frequency band may vary accordingly. The method of connecting an electrical connection member may be utilized as a tuning factor for ensuring the performance of an antenna. Namely, in the case of a mobile terminal to which a conductive member (e.g., a metal housing, a metal member, etc.) with a constant antenna radiator length is applied, the antenna radiator length cannot be directly adjusted, so the resonant length of the antenna radiator may be adjusted through the connection method, and the method may also be utilized as a tuning factor of the antenna radiator.

Various embodiments of the present disclosure may provide an electronic device that includes: a housing; a first conductive member configured to form a part of the housing, or at least partially disposed within the housing, wherein the first conductive member includes a first conductive protrusion directed toward the inside of the housing; a second conductive member configured to form another part of the housing, wherein the second conductive member includes a portion disposed adjacent to a portion of the first conductive member and a second conductive protrusion directed toward the inside of the housing; a non-conductive member disposed between the portion of the first conductive member and the portion of the second conductive member; a coupling structure that is connected between the first conductive protrusion and the second conductive protrusion and includes a conductor; and at least one communication circuit electrically connected to the second conductive member.

The housing is an example of a housing that is similar to, or different from, the conductive member 410 of FIG. 4A.

The first conductive member is an example of a conductive member that is similar to, or different from, the lower conductive member 414 of FIG. 4A.

The second conductive member is an example of a conductive member that is similar to, or different from, the right conductive member 411 of FIG. 4A.

The first conductive protrusion is an example of a conductive protrusion that is similar to, or different from, the first ground piece 4142 of FIG. 4A.

The second conductive protrusion is an example of a conductive protrusion that is similar to, or different from, the third ground piece 4112 of FIG. 4A.

The coupling structure is an example of a coupling structure that is similar to, or different from, the electrical connection member 470 of FIG. 4A.

According to various embodiments, the at least one communication circuit may be configured to transmit and receive a signal of at least one frequency between about 2 GHz and about 3 GHz through the second conductive member.

According to various embodiments, the at least one communication circuit may be configured to transmit and receive a signal of at least one frequency between about 2.5 GHz and about 2.7 GHz through the second conductive member.

According to various embodiments, the at least one communication circuit may be electrically connected to the first conductive member.

According to various embodiments, the at least one communication circuit may be configured to transmit and receive a signal of at least one frequency between about 700 MHz and about 2.5 GHz through the first conductive member and to transmit and receive a signal of at least one frequency between about 2 GHz and about 3 GHz through the second conductive member.

According to various embodiments, the conductor of the coupling structure may electrically connect the first conductive protrusion and the second conductive protrusion.

According to various embodiments, the electronic device may further include a ground plane 4001 within the housing, a part of the first conductive protrusion may be electrically connected to the ground plane 4001, and a part of the second conductive protrusion may be electrically connected to the ground plane 4001.

According to various embodiments, a first electrical path from the part of the first conductive protrusion to the second conductive protrusion via the ground plane 4001 may have a first length, and a second electrical path from the first conductive protrusion to the second conductive protrusion via the conductor of the coupling structure may have a second length shorter than the first length.

According to various embodiments, the second electrical path may include a capacitive type coupling structure.

According to various embodiments, the coupling structure may include: a first non-conductive structure configured to make contact with the first conductive protrusion and the second conductive protrusion; a second non-conductive structure disposed so as to be spaced apart from the first non-conductive structure; and a first conductive structure inserted between the first non-conductive structure and the second non-conductive structure, and the first conductive structure may be electrically isolated from the first and second conductive protrusions, or may be electrically isolated from one of the first and second conductive protrusions and may be electrically connected with the other conductive protrusion.

The first non-conductive structure is an example of a non-conductive structure that is similar to, or different from, the insulating double-sided tape 573 of FIG. 5.

The second non-conductive structure is an example of a non-conductive structure that is similar to, or different from, the insulating film 572 of FIG. 5.

According to various embodiments, the coupling structure may further include: a third non-conductive structure; and a second conductive structure inserted between the second non-conductive structure and the third non-conductive structure, and the second conductive structure may be electrically isolated from the first and second conductive protrusions, or may be electrically isolated from one of the first and second conductive protrusions and may be electrically connected with the other conductive protrusion.

According to various embodiments, the first non-conductive structure may include a first non-conductive film, and the first non-conductive film may include at least one first adhesive layer on a first surface directed toward the first conductive protrusion and/or the second conductive protrusion.

According to various embodiments, the first non-conductive film may further include at least one second adhesive layer on a second surface directed toward the opposite side of the first conductive protrusion and/or the second conductive protrusion.

According to various embodiments, the first non-conductive structure may include at least one adhesive layer.

According to various embodiments, the first non-conductive structure may include a first non-conductive material, and the second non-conductive structure may include a second non-conductive material that is different from the first non-conductive material.

According to various embodiments of the present disclosure, the first non-conductive material may include an acrylic adhesive, and the second non-conductive material may include polyimide.

According to various embodiments, the housing may include a first surface, a second surface opposite to the first surface, and a side surface configured to surround at least a part of the space between the first surface and the second surface. The first conductive member may form a first portion of the side surface, the second conductive member may form a second portion of the side surface, which is adjacent to the first portion, and the first non-conductive member may include a third portion of the side surface, which is disposed between the first portion and the second portion of the side surface.

According to various embodiments of the present disclosure, the first portion and the second portion may have a gap of 0.1 mm to 3 mm therebetween.

According to various embodiments of the present disclosure, the housing may include a first side; and a second side that is perpendicularly connected to the first side and is longer than the first side. The first conductive member may form a part of the first side, and the second conductive member may form another part of the first side.

According to various embodiments of the present disclosure, the second conductive member may additionally form a part of the second side.

According to various embodiments of the present disclosure, the electronic device may further include a sensor electrically connected with the first conductive member and configured to detect an external object's access to, or contact with, the first conductive member.

The sensor is an example of a sensor that is similar to, or different from, the sensor module 480 of FIG. 4A.

According to the various embodiments of the present disclosure, by applying an electrical connection member that may electrically connect two conductive members, it is possible to minimize the electrical length from the power supply position of one conductive member to the ground portion of the other conductive member, thereby shifting the operating frequency band to a desired frequency band (e.g., a high frequency band).

According to the various embodiments of the present disclosure, it is possible to enhance the radiation performance of the antenna and the sensing function and to control leakage current by electrically connecting (e.g., welding, etc.) two conductive members through an electrical connection member that includes a conductor, or by capacitively connecting the two conductive members through coupling.

The embodiments of the present disclosure disclosed in the specification and the drawings are examples to describe the technical matters of the present disclosure and help with comprehension of the present disclosure, and do not limit the scope of the present disclosure. Therefore, in addition to the embodiments disclosed herein, the scope of the various embodiments of the present disclosure should be construed to include all modifications or modified forms drawn based on the technical idea of the various embodiments of the present disclosure as defined by the appended claims and their equivalents.

What is claimed is:

1. An electronic device comprising:

a housing;

a ground plane within the housing;

a first conductive member configured to form a part of the housing or to be partially disposed within the housing, and comprising a first conductive protrusion disposed toward the inside of the housing, wherein a first end of the first conductive protrusion is electrically connected to the ground plane;

a second conductive member configured to form another part of the housing, and comprising a second conductive protrusion disposed toward the inside of the housing, wherein a second end of the second conductive protrusion is electrically connected to the ground plane, and wherein a first portion of the first conductive member is disposed adjacent to a second portion of the second conductive member;

a non-conductive member interposed between the first portion of the first conductive member and the second portion of the second conductive member such that the first portion is separated from the second portion;

a coupling structure comprising a conductor, wherein the first conductive protrusion and the second conductive protrusion are connected with the coupling structure; and at least one communication circuit electrically connected to the second conductive member, wherein a first electrical path from the first conductive member to the second conductive member via the ground plane has a first length, and a second electrical path from the first conductive member to the second conductive member via the coupling structure has a second length which is shorter than the first length.

2. The electronic device of claim 1, wherein the at least one communication circuit is configured to transmit and receive a signal of at least one frequency between about 2 GHz and about 3 GHz through the second conductive member.

3. The electronic device of claim 2, wherein the at least one communication circuit is configured to transmit and receive a signal of at least one frequency between about 2.5 GHz and about 2.7 GHz through the second conductive member.

4. The electronic device of claim 1, wherein the at least one communication circuit is electrically connected to the first conductive member.

5. The electronic device of claim 4, wherein the at least one communication circuit is configured to transmit and receive a signal of at least one frequency between about 700 MHz and about 2.5 GHz through the first conductive member and to transmit and receive a signal of at least one frequency between about 2 GHz and about 3 GHz through the second conductive member.

6. The electronic device of claim 1, wherein the conductor of the coupling structure electrically connects the first conductive protrusion and the second conductive protrusion.

7. The electronic device of claim 1, wherein the second electrical path comprises a capacitive type coupling structure.

8. The electronic device of claim 1, wherein the coupling structure comprises:

a first non-conductive structure configured to make contact with the first conductive protrusion and the second conductive protrusion;

a second non-conductive structure spaced apart from the first non-conductive structure; and a first conductive structure inserted between the first non-conductive structure and the second non-conductive structure, wherein the first conductive structure is electrically isolated from the first and second conductive protrusions, or is electrically isolated from one of the first and second conductive protrusions and is electrically connected with the other conductive protrusion.

9. The electronic device of claim 8, wherein the coupling structure further comprises:

a third non-conductive structure; and a second conductive structure disposed between the second non-conductive structure and the third non-conductive structure, wherein the second conductive structure is electrically isolated from the first and second conductive protrusions, or is electrically isolated from one of the first and second conductive protrusions and is electrically connected with the other conductive protrusion.

10. The electronic device of claim 8, wherein the first non-conductive structure comprises a first non-conductive film, and the first non-conductive film comprises at least one first adhesive layer on a first surface directed toward at least one of the first conductive protrusion and the second conductive protrusion.

11. The electronic device of claim 10, wherein the first non-conductive film further comprises at least one second adhesive layer on a second surface directed toward at least one of an opposite side of the first conductive protrusion and the second conductive protrusion.

12. The electronic device of claim 8, wherein the first non-conductive structure comprises at least one adhesive layer.

13. The electronic device of claim 8, wherein the first non-conductive structure comprises a first non-conductive material, and the second non-conductive structure comprises a second non-conductive material that is different from the first non-conductive material.

14. The electronic device of claim 13, wherein the first non-conductive material comprises an acrylic adhesive, and the second non-conductive material comprises polyimide.

15. The electronic device of claim 1, wherein the housing comprises a first surface, a second surface opposite to the first surface, and a side surface configured to surround at least a part of a space between the first surface and the second surface, wherein the first conductive member forms a first portion of the side surface, the second conductive member forms a second portion of the side surface, which is adjacent to the first portion, and the first non-conductive member comprises a third portion of the side surface, which is disposed between the first portion and the second portion of the side surface.

16. The electronic device of claim 1, wherein the housing comprises a first side and a second side that is perpendicularly connected to the first side and is longer than the first side, wherein the first conductive member forms a part of the first side, and the second conductive member forms another part of the first side.

17. The electronic device of claim 16, wherein the second conductive member forms a part of the first side and the second side.

18. The electronic device of claim 1, wherein the electronic device further comprises a sensor electrically connected with the first conductive member and configured to detect an external object's access to, or contact with, the first conductive member.

* * * * *